US006499279B1

(12) United States Patent
Yamamoto et al.

(10) Patent No.: US 6,499,279 B1
(45) Date of Patent: Dec. 31, 2002

(54) CAPSULE FILLING MACHINE

(75) Inventors: Taizo Yamamoto, Osaka (JP); Hirokazu Konishi, Sakurai (JP)

(73) Assignee: Shionogi Qualicaps Co., Ltd., Nara-ken (JP)

( * ) Notice: Subject to any disclaimer, the term of this patent is extended or adjusted under 35 U.S.C. 154(b) by 0 days.

(21) Appl. No.: 09/550,281

(22) Filed: Apr. 14, 2000

(51) Int. Cl.[7] ..... B65B 47/00

(52) U.S. Cl. ..... 53/560; 53/276; 53/282; 53/328; 53/468; 53/503; 53/900

(58) Field of Search ..... 53/467, 468, 471, 53/478, 485, 503, 504, 560, 454, 900, 276, 328, 329, 281, 282, 283

(56) References Cited

U.S. PATENT DOCUMENTS

| | | | | |
|---|---|---|---|---|
| 803,145 A | * | 10/1905 | Winchester | 53/900 |
| 1,839,820 A | | 1/1932 | Wilkie | |
| 4,723,570 A | | 2/1988 | Baba et al. | |
| 4,731,979 A | | 3/1988 | Yamamoto et al. | |
| 4,964,262 A | * | 10/1990 | Moser et al. | 53/506 |
| 5,018,335 A | | 5/1991 | Yamamoto et al. | |
| 5,348,062 A | * | 9/1994 | Hartzell et al. | 141/186 |
| 5,495,702 A | * | 3/1996 | Ko | 53/381.4 |
| 5,743,069 A | * | 4/1998 | Ansaloni | 53/167 |
| 6,073,657 A | * | 6/2000 | Hippelainen et al. | 138/125 |

FOREIGN PATENT DOCUMENTS

| | | | | |
|---|---|---|---|---|
| EP | 0376711 | | 7/1990 | |
| EP | 0524024 | * | 1/1993 | A61J/3/07 |
| JP | 37388 | | 2/1991 | |
| JP | 458340 | | 9/1992 | |

* cited by examiner

*Primary Examiner*—Rinaldi I. Rada
*Assistant Examiner*—Christopher Harmon
(74) *Attorney, Agent, or Firm*—Birch, Stewart, Kolasch & Birch, LLP

(57) ABSTRACT

A capsule filling machine is provided which is characterized in that contents substance m is force fed into a body B accommodated and held in a body pocket 221 using a force feeding screw 33 to fill the contents substance m.

24 Claims, 15 Drawing Sheets

CAPSULE FILLING MACHINE

BACKGROUND OF THE INVENTION

The present invention relates to a capsule filling machine by which an empty capsule composed of a cap and a body temporarily coupled to each other is transported while the posture thereof is controlled to an erected state with the cap directed upwardly and, during the transportation, the empty capsule is separated into the cap and the body and contents substance is filled into the body, whereafter the cap and the body are coupled to each other again to produce a filled capsule product, and more particularly to a capsule filling machine by which, even when it fills contents substance which is very low in bulk density and very inferior in fluidity or formability such as crushed substance of weeds, grass or tea leaves or silicon dioxide and which it is difficult for a conventional filling machine to fill by a fixed amount with certainty, it can be filled by a fixed amount with certainty to obtain a filled capsule product stably.

Conventionally, filled capsule products such as pharmaceutical capsules as medicine or so-called health foods formed from capsules filled with various foods are produced by automatically filling contents substance into capsules using a capsule filling machine.

Usually, a capsule filling machine is constructed such that a hard empty capsule composed of a cap and a body temporarily coupled to each other is transported while the posture thereof is controlled to an erected state wherein the cap is directed upwardly and, during the transportation, the empty capsule is separated into the cap and the body and contents substance is filled into the body, whereafter the cap and the body are coupled to each other again to produce a filled capsule product.

In this instance, as means for filling contents substance into the body of the empty capsule in a state wherein the cap and the body thereof are separate from each other, a system wherein various contents substance of various kinds of powder and so forth are formed into a predetermined rigid material and charged as such into the capsule body (the official gazette of Japanese Patent Publication No. Hei 3-7388) or another system wherein contents substance in the form of powder or granule is flown into the capsule body by vibrations or the like (the official gazette of Japanese Patent Publication No. Hei 4-58340) is adopted.

However, the conventional capsule filling machine cannot sometimes exhibit a sufficient performance depending upon the type of contents substance.

In particular, contents substance to be filled into a capsule may assume various forms, and a large number of kinds of contents substances which are inferior in formability or fluidity are present. For example, contents which are low in bulk density and inferior in formability and fluidity such as silicon dioxide powder which is used as a medicine or an additive to food cannot be efficiently filled by a predetermined amount into a capsule by the conventional capsule filling machine described above by which contents substance is filled by the system wherein it is formed once and charged as such into the capsule body or the system wherein vibrations are applied to contents substance so that the contents substance is flowed into the capsule body. Further, although, in recent years, applications of hard capsules in the field of so-called nutritional foods other than applications to the medicine have been and are increasing, since the properties of nutritional foods are more various than the medicine, many nutritional foods are difficult to fill into a capsule using the conventional capsule filling machine described above. Also, many nutritional foods are very low in bulk density and have little formability or fluidity such as, for example, crushed substance of weeds, grass or tea leaves, and it is almost impossible for the conventional capsule filling machine described above to fill such nutritional foods into a capsule to stably produce a filled capsule product of a fixed content.

SUMMARY OF THE INVENTION

The present invention has been made in view of the circumstances described above, and it is an object of the present invention to provide a capsule filling machine by which, even where contents substance is low in bulk density and inferior in formability and fluidity, it can be filled well into a capsule and a filled capsule product of a fixed content can be produced with certainty.

In order to attain the object described above, according to the present invention, there is provided a capsule filling machine which includes a cap transport member having a cap pocket in the form of a through-hole for accommodating a cap of a capsule and a body transport member having a body pocket for accommodating a body of the capsule and wherein the cap transport member is placed on the body transport member such that the cap pocket and the body pocket are registered with each other and an empty capsule in a condition wherein the cap and the body are temporarily coupled to each other is accommodated into and transported in a capsule pocket formed from the cap pocket and the body pocket in an erected state wherein the cap is directed upwardly, and then, during transportation of the empty capsule, the cap and the body are separated from each other in the capsule pocket and the cap is held in the cap pocket while the body is held in the body pocket, whereafter the cap transport member and the body transport member are separated from each other once and contents substance is filled into the body accommodated in the body pocket of the body transport member, and then the cap transport member is placed onto the body transport member such that the cap pocket and the body pocket are registered with each other and the cap and the body are coupled to each other within the capsule pocket formed from the cap pocket and the body pocket to produce a filled capsule product, characterized in that it comprises a contents substance filling member including a force feeding screw disposed in a chamber having a lower end opening disposed above the body transport member, and when the cap transport member and the body transport member are separated from each other, contents substance is force fed and filled into the body accommodated in the body pocket of the body transport member by the contents substance filling member.

In particular, the capsule filling machine of the present invention fills contents substance such as medicine or foods into a capsule body, which is separate from a cap and is accommodated and held in the body pocket of the body transport member, by the contents substance filling unit disposed on the body transport member and couples the capsule body to the cap again to obtain a filled capsule product such as a pharmaceutical capsule or capsule foods.

In this instance, in the present invention, the contents substance filling unit used includes the force feeding screw disposed in the chamber so that contents substance supplied into the chamber is compulsorily force fed into the capsule body by the force feeding screw.

Accordingly, with the capsule filling machine of the present invention, even if the contents substance to be filled into a capsule is low in bulk density and inferior in formability and fluidity, it can be compulsorily force fed and filled into the capsule body by the force feeding screw, and filled capsule products in which a predetermined amount of contents substance is filled can be produced stably and with certainty.

DESCRIPTION OF THE PREFERRED EMBODIMENT

Figure 1:
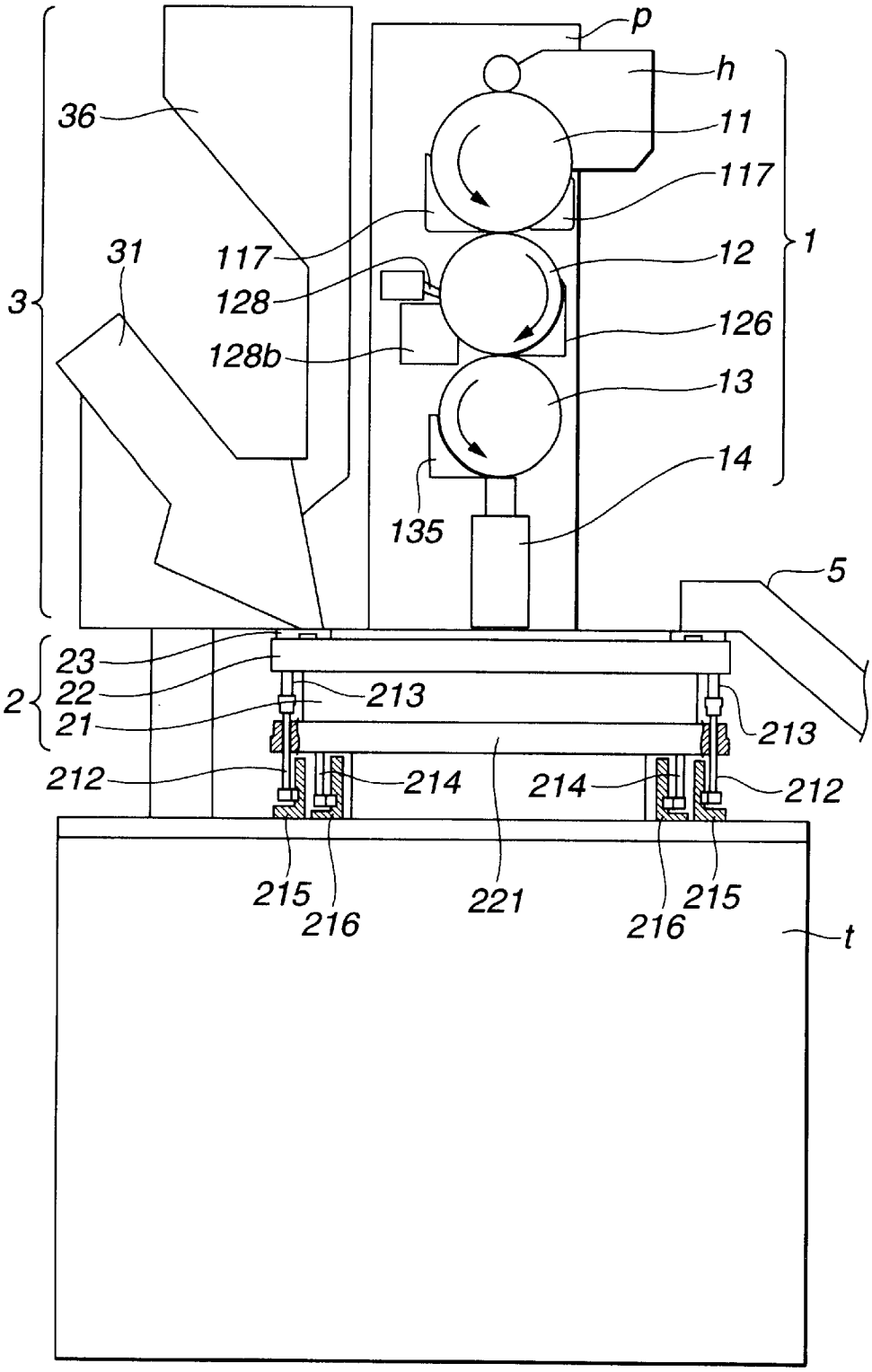
FIG. 1 is a schematic front elevational view showing a capsule filling machine according to an embodiment of the present invention.
Figure 2:
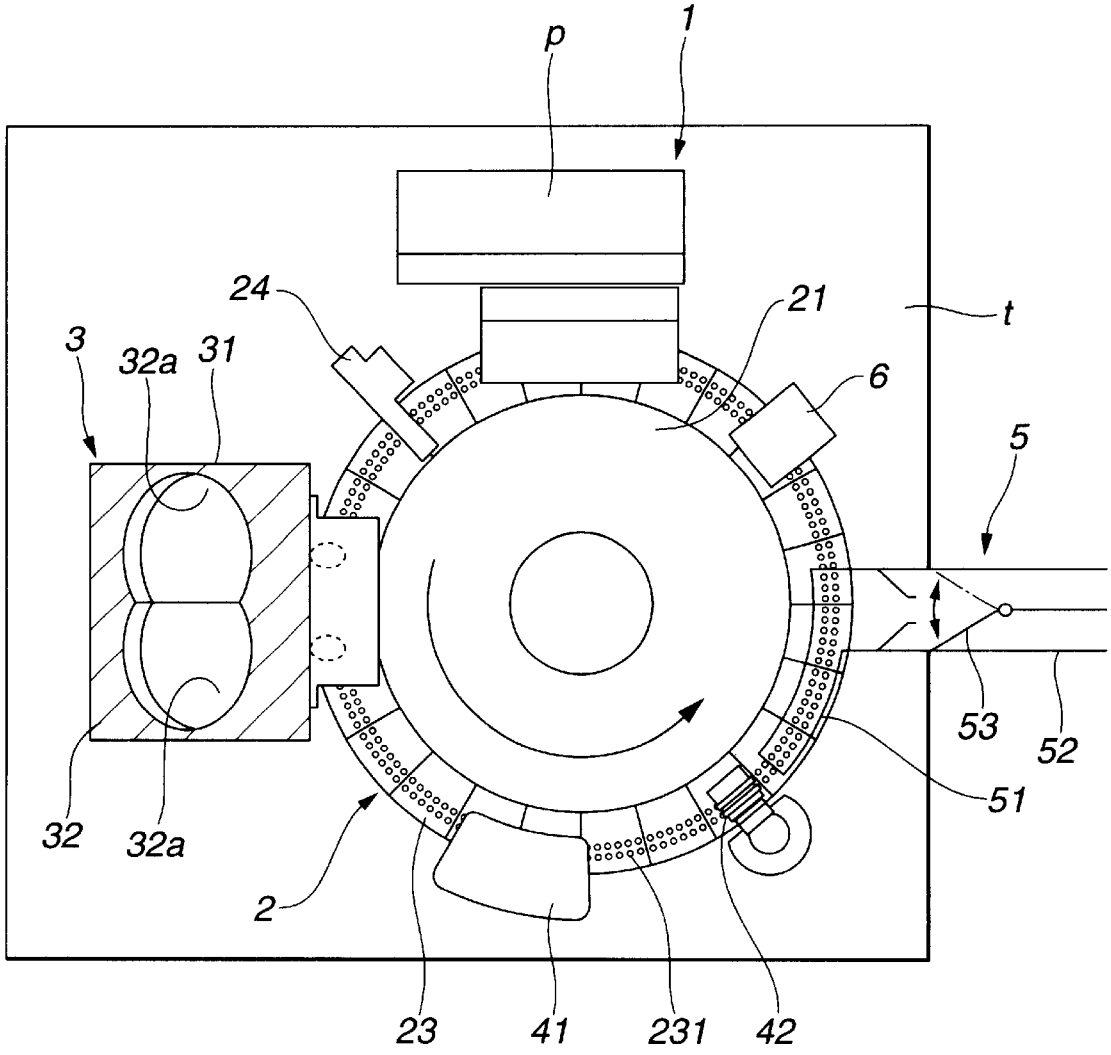
FIG. 2 is a schematic plan view showing the capsule filling machine.

FIGS. 1 and 2 show a capsule filling machine according to an embodiment of the present invention. The capsule filling machine includes a supplying section 1 for successively supplying empty capsules formed from a cap and a body temporarily coupled to each other (such capsules are hereinafter referred to merely as "empty capsules" in an erected state wherein the cap is directed upwardly, a transport section 2 for successively transporting the empty capsules supplied from the supplying section 1, and a filling section 3 for filling contents substance into the bodies of the empty capsules. The capsule filling machine successively transports, by means of the transport section 2, empty capsules successively supplied in an erected state from the supplying section 1 and, during the successive transportation, separates each of the empty capsules into the cap and the body once, fills contents substance such as medicine or foods into the body by means of the filling section 3 and couples the cap and the body to each other again thereby to fully automatically produce filled capsule products such as pharmaceutical capsules or capsule-type foods. It is to be noted that, in FIGS. 1 and 2, reference character t denotes a platform on which a driving source (not shown) for driving the supplying section 1, transport section 2 and filling section 3 is disposed.

The supplying section 1 includes, as shown in FIG. 1, a supply drum 11 for successively supplying empty capsules accommodated in a hopper h in vertically standing states wherein empty capsules in an erected state with the cap directed upwardly and empty capsules in an inverted state with the body directed upwardly are present in a mixed manner, a direction controlling drum 12 for controlling the directions of the empty capsules received from the supply drum, a feeding drum 13 for receiving the empty capsules all in an inverted state with the body directed upwardly from the direction controlling drum 12 and transporting the empty capsules downwardly, and a magazine 14 for loading the empty capsules in an erected state received from the feeding drum 13 into capsule pockets of the transport section 2. It is to be noted that "upward/downward" directions of empty capsules held on the drums 11, 12 and 13 are upward/downward directions where the outer periphery side of each of the drums 11, 12 and 13 is represented as upward while the center side is represented as downward, and the "erected state" signifies a state wherein the empty capsule is held along a diametrical direction of the drum with the cap positioned on the outer periphery side of the drum and with the body directed to the center side of the drum. Further, the "inverted state" signifies a state wherein the empty capsule is held along a diametrical direction of the drum with the body positioned on the outer periphery side of the drum and with the cap directed toward the center side of the drum. Further, the "vertically standing state" signifies a state wherein the empty capsule is held along a diametrical direction of the drum irrespective of the directions of the cap and the body.

Figure 5A:
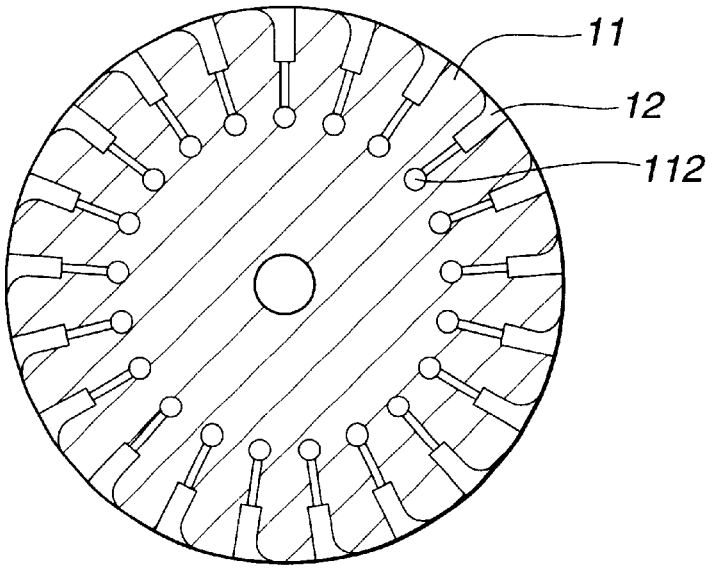
FIGS. 5A and 5B are sectional views showing a supply drum which forms the supplying section.
Figure 5B:
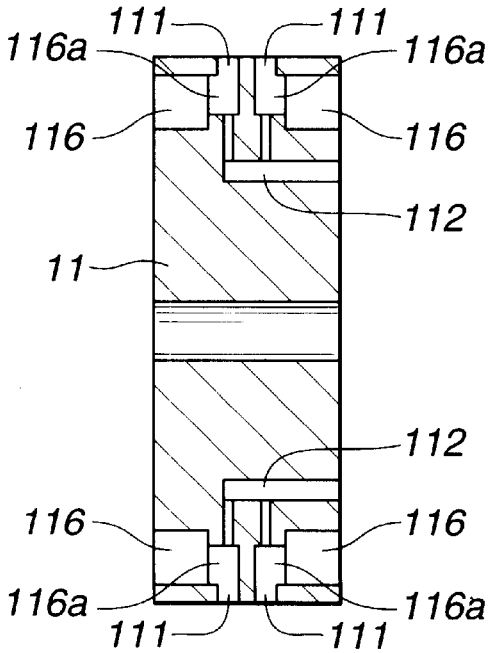

As shown in FIGS. 5A and 5B, two rows of 21 supply pockets 111 capable of accommodating empty capsules in a vertically standing state therein are formed along a circumferential direction on a circumferential face of the supply drum 11. When the supply drum 11 rotates in the counterclockwise direction in FIG. 1, empty capsules AB stored in the hopper h are successively accommodated into the supply pockets 111.

Each of the supply pockets 111 is formed in such a shape that an opening thereof is partly expanded in a direction of rotation so that an empty capsule from the hopper h may be introduced readily into the supply pocket 111, and is communicated with a sucking/blowing out hole 112 formed along an axial direction of the supply drum 11 in the proximity of the supply pocket 111 on the inner side in a diametrical direction. As shown in FIG. 5B, one sucking/blowing out hole 112 is communicated with two supply pockets 111, 111 which are juxtaposed along a widthwise direction of the supply drum 11 and is open to one side face of the supply drum 11. Further, each supply pocket 111 has a capsule discharging window 116*a* provided at a lower portion thereof which communicates with a capsule discharging space portion 116 which is open to the outer side face of the supply drum 11.

Figure 3:
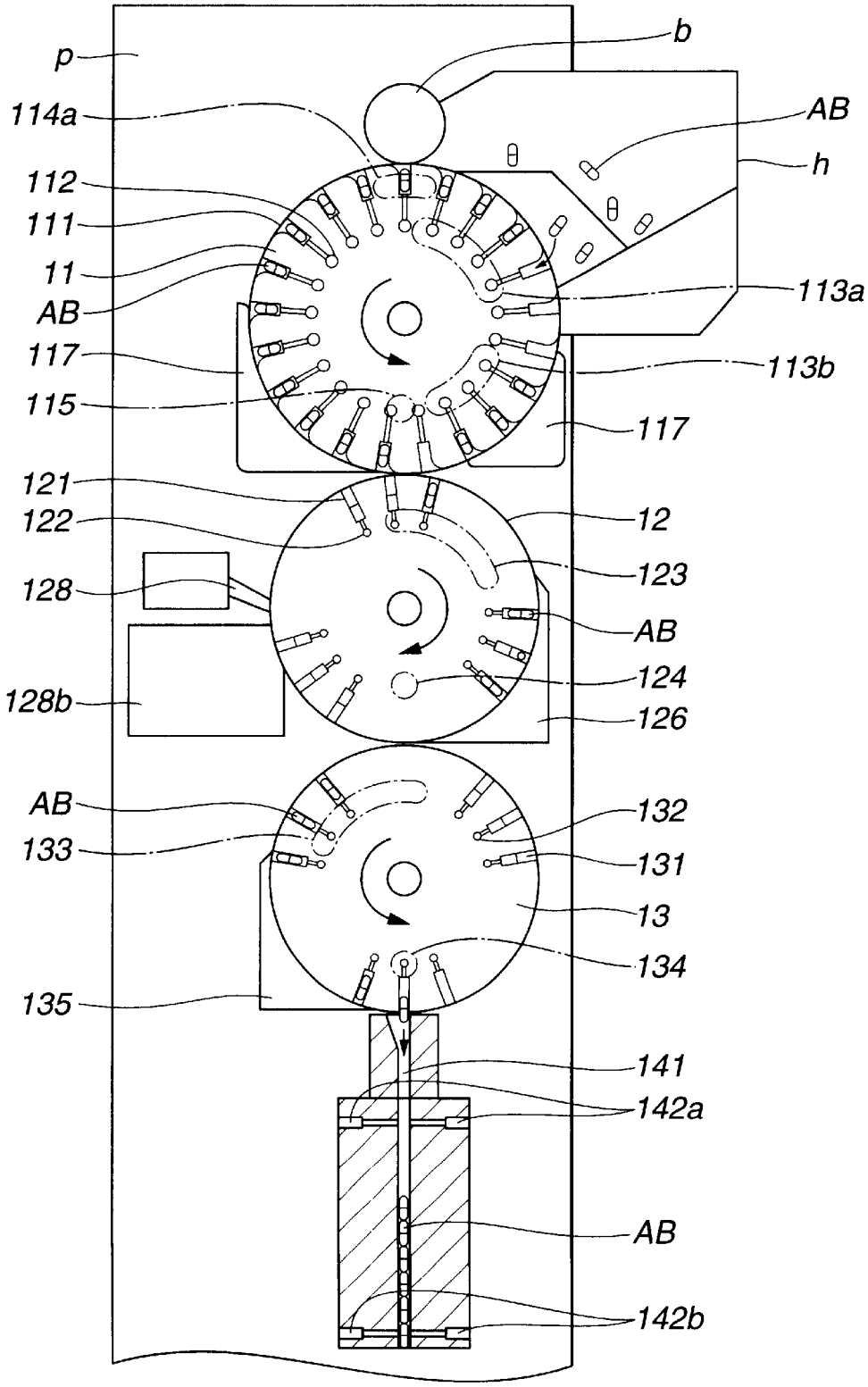
FIG. 3 is a schematic view showing a supplying section of the capsule filling machine.
Figure 4:
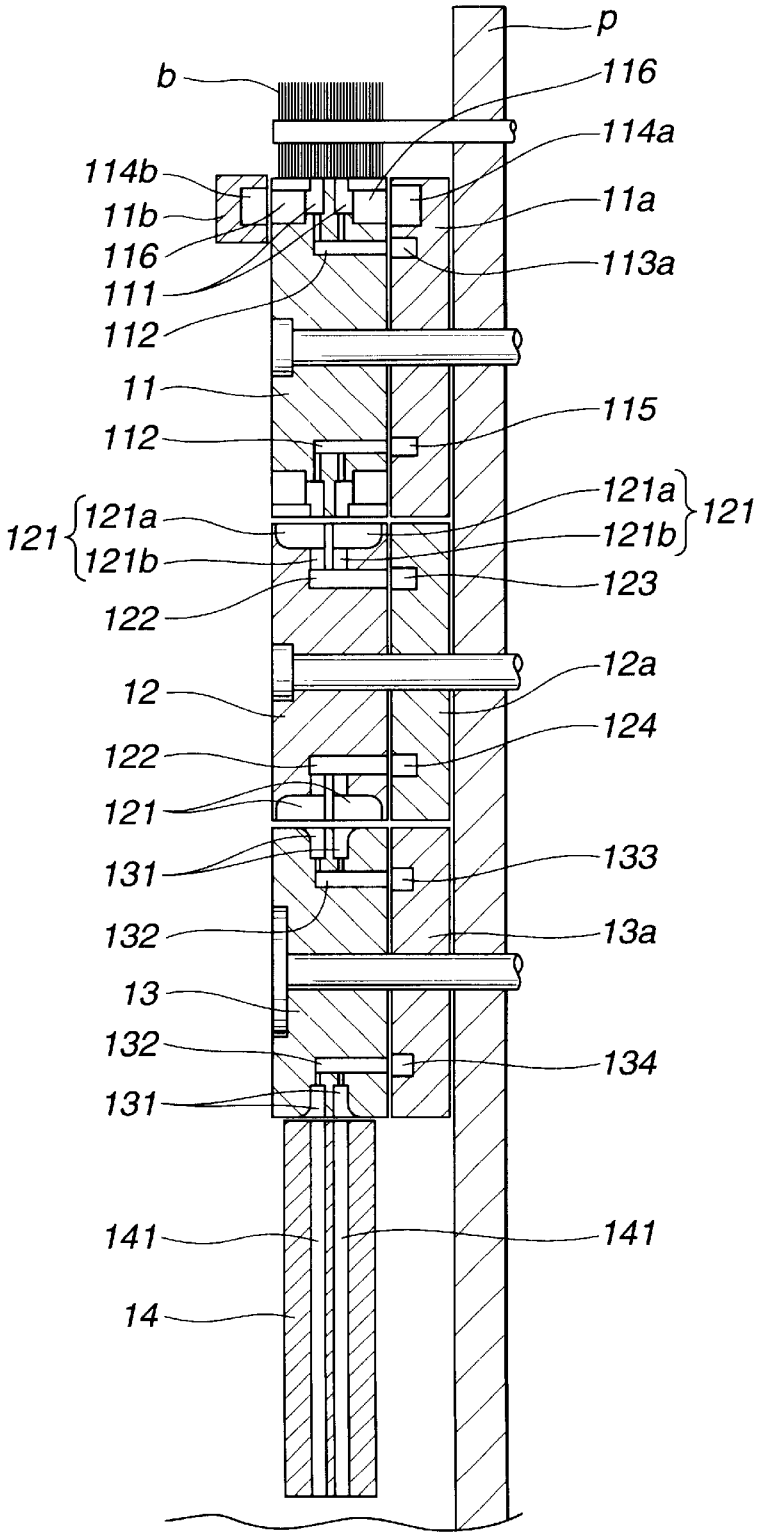
FIG. 4 is a schematic sectional view showing the supplying section.
Figure 6A:
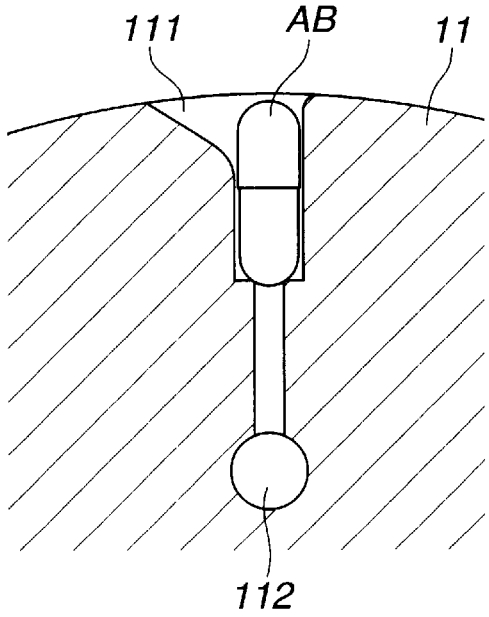
FIG. 6A is an enlarged sectional view showing an empty capsule accommodated and held in the supply drum and FIG. 6B is an enlarged sectional view illustrating a behavior of the empty capsule.
Figure 6B:
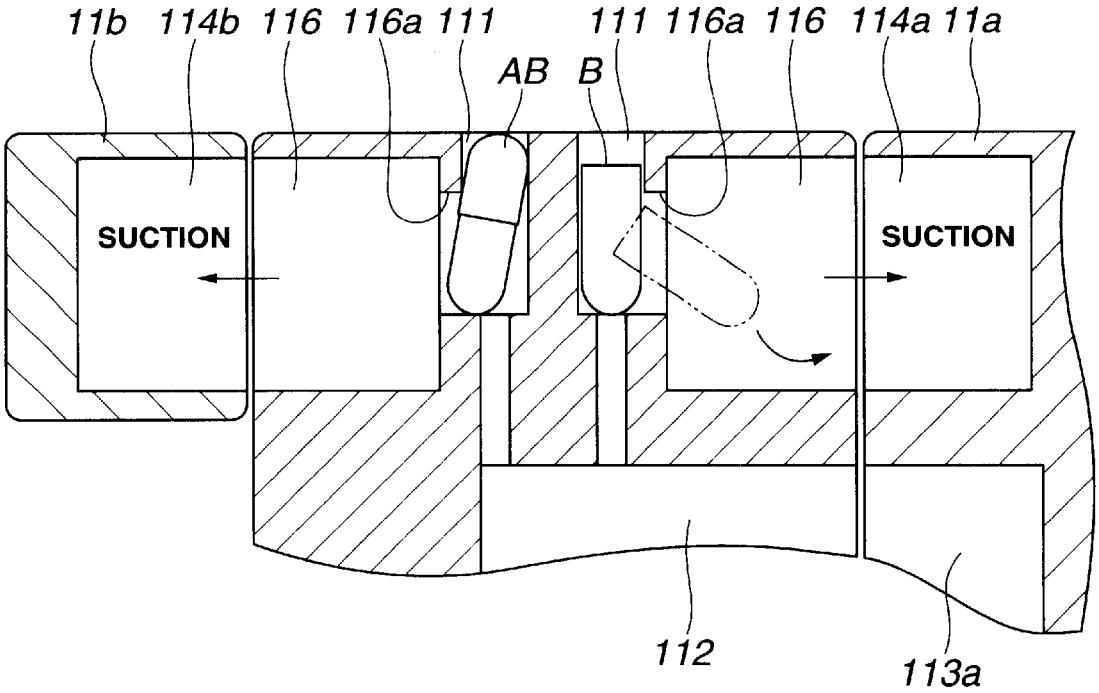

Meanwhile, as shown in FIG. 4, a first suction and exhaust block 11*a* is disposed between the supply drum 11 and a column p which supports the supply drum 11 for rotation thereon, and three suction paths 113*a*, 113*b* and 114*a* and one compressed air path 115 are provided on a front face side of the suction and exhaust block 11*a* (adjacent to the supply drum 11) as shown in FIGS. 3 and 4. In a condition wherein the suction paths 113*a* and 113*b* and the sucking/blowing out holes 112 are registered with each other, a negative pressure acts inside the supply pockets 111, but in another condition wherein the compressed air path 115 and a sucking/blowing out hole 112 are registered with each other, air is blown out into the supply pocket 111. Meanwhile, as shown in FIGS. 4 and 6B, a small suction block 11*b* having a suction path 114*b* opposing to the suction path 114*a* is disposed on the opposite side to the first suction and exhaust block 11*a* with respect to the supply drum 11, and in a condition wherein the suction path 114*b* of the small suction block 11*b* and the suction path 114*a* of the first suction and exhaust block 11*a* are registered with the capsule discharging space portions 116, a negative pressure acts inside the supply pockets 111 by sucking from the side face sides thereof.

Further, as shown in FIGS. 1 and 3, a pair of left and right guide members 117, 117 for preventing letting off of capsules are provided along a circumferential face of the supply drum 11 such that they extend from middle portions toward the lower side of the supply drum 11 in the upward and downward directions. A capsule discharging gap is provided between the two guide members 117, 117 at a position just below the supply drum 11.

Figure 7A:
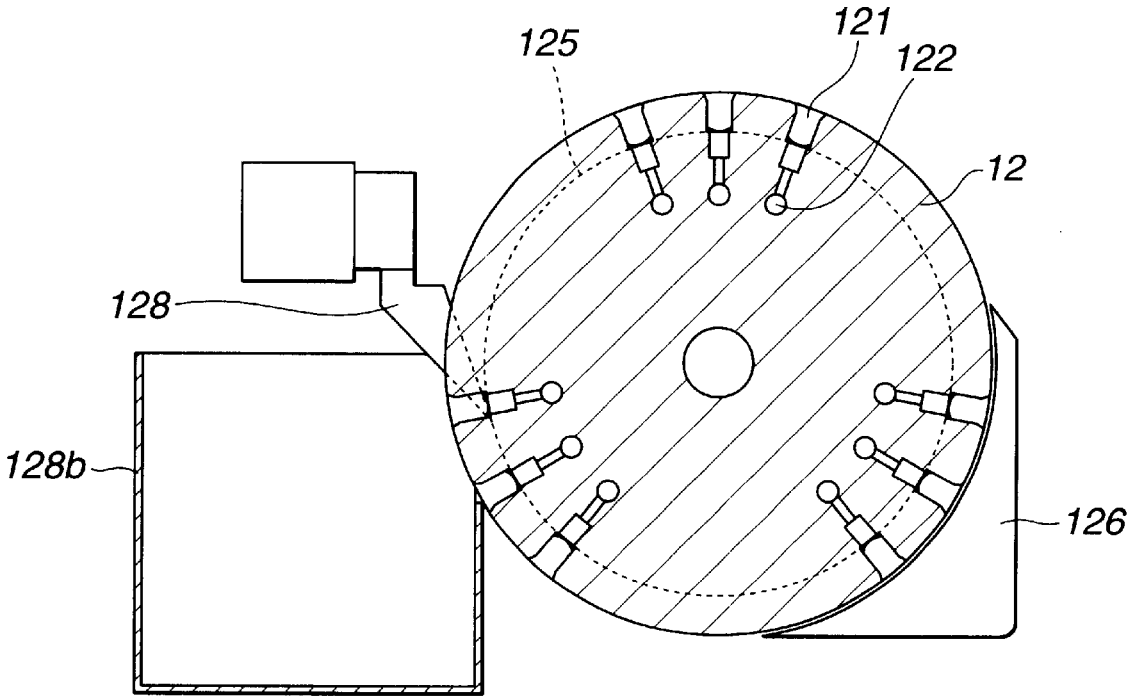
FIGS. 7A and 7B are schematic views showing a direction controlling drum which forms the supplying section.
Figure 7B:
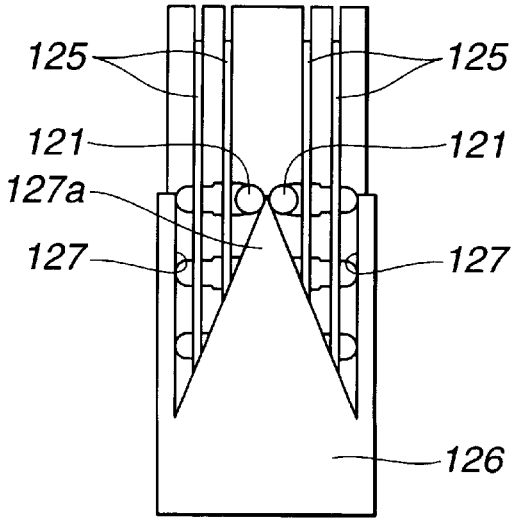
Figure 8A:
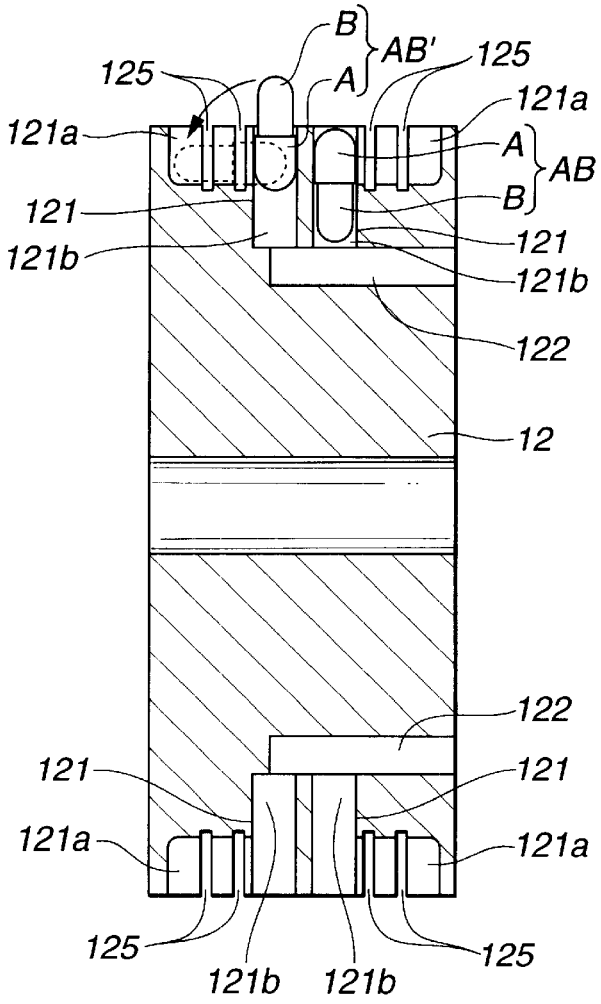
FIG. 8A is an enlarged sectional view showing the direction controlling drum and FIG. 8-B is an enlarged plan view showing a direction controlling pocket provided on the direction controlling drum.
Figure 8B:
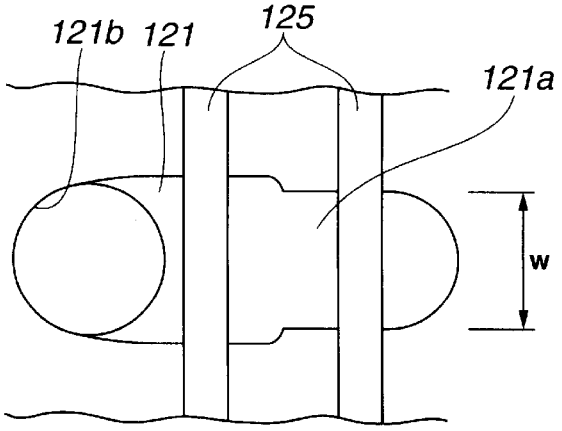

Meanwhile, the direction controlling drum 12 is formed with a diameter smaller than the supply drum 11 and is disposed below the supply drum 11 such that a circumferential face thereof is close to the supply drum 11. The direction controlling drum 12 rotates in the opposite direction (in the clockwise direction in FIGS. 1 and 3) to that of the supply drum 11 at an equal circumferential speed to that of the supply drum 11. As shown in FIGS. 7A and 7B, three sets of direction controlling sections each including totaling six direction controlling pockets 121 arranged in three rows and two columns are provided in an equally spaced relationship from each other in a circumferential direction on the circumferential face of the direction controlling drum 12. As shown in FIGS. 8A and 8B, each of the direction controlling pockets 121 is composed of an upper portion 121*a* of a substantially elongated elliptical shape capable of accommodating an empty capsule AB, which includes a cap A and a body B temporarily coupled to each other, in a horizontally lying state along a widthwise direction of the direction controlling drum 12, and a bottom portion 121*b* communicated with an end portion of the upper portion 121*a* and having a diameter set such that the cap portion A of an empty capsule AB cannot advance into the bottom portion 121*b* but only the body portion B can advance into the bottom portion 121*b*.

As shown in FIG. 8A, the bottom portion 121*b* of each of the direction controlling pockets 121 is communicated with a suction/blowing out hole 122 formed in the proximity of a diametrically inner side of the direction controlling drum 12, and one suction/blowing out hole 122 is communicated with two direction controlling pockets 121, 121 juxtaposed along a widthwise direction of the direction controlling drum 12 and is open to one side face of the direction controlling drum 12. Further, as shown in FIG. 4, a second suction and exhaust block 12*a* is disposed between the column p on which the direction controlling drum 12 is supported and the direction controlling drum 12 in a similar manner as in the case of the supply drum 11 described hereinabove, and a suction path 123 and a compressed air path 124 are provided on a front face side of the second suction and exhaust block 12*a* (adjacent to the direction controlling drum 12) as shown in FIGS. 3 and 4. In a condition wherein the suction path 123 and the suction/blowing out hole 122 are registered with each other, a negative pressure acts inside the direction controlling pocket 121, but in another condition wherein the compressed air path 124 and the suction/blowing out hole 122 are registered with each other, air is blown out into the direction controlling pocket 121.

Meanwhile, as shown in FIG. 8B, the upper portion 121*a* of each of the direction controlling pockets 121 is formed such that it has a reduced width at a free end side thereof. The width W of the reduced width portion is set a little greater than the diameter of the body B of the empty capsule AB but a little smaller than the diameter of the cap A so that an empty capsule AB accommodated in the upper portion 121*a* of the direction controlling pocket 121 with the cap A thereof directed to the reduced width portion side may be held at the cap A portion thereof by the reduced width portion and cannot be discharged readily. Further, two sets of scraper insertion grooves 125, each set including two scraper insertion grooves 125, are formed along a circumferential direction of the drum 12 on the outer circumferential face of the direction controlling drum 12 as shown in FIGS. 7A, 7B, 8A and 8B. The two sets of scraper insertion grooves 125, 125 extend across the upper portions 121*a* of the direction controlling pockets 121.

As shown in FIGS. 1, 3, 7A and 7B, a direction controlling guide member 126 for performing prevention of letting off and direction controlling of empty capsules AB accommodated in the direction controlling pockets 121 is provided along the circumferential face of the direction controlling drum 12 over an approximately ¼ circumferential portion from one side portion (right side portion in the figures) to the lower side. The direction controlling guide member 126 has two V-shaped grooves 127, 127 formed thereon corresponding to the direction controlling pockets 121 as shown in FIG. 7B, and a mountain-shaped portion formed between the V-shaped grooves 127, 127 serves as a direction controlling protrusion 127*a* for laying down an empty capsule AB accommodated in the direction controlling pocket 121 in an inverted state into a horizontally lying state.

Further, as shown in FIGS. 1, 3 and 7A, four spike-shaped scrapers 128 are disposed at the other side portion of the circumferential face of the direction controlling drum 12 (on the opposite side to the direction controlling guide member 126), and extremities of them are fitted in the scraper insertion grooves 125. Further, a recovery can 128*b* for recovering empty capsules AB discharged from the upper portions 121*a* of the direction controlling pockets 121 by the scrapers 128 is disposed below the scrapers 128.

Figure 9A:
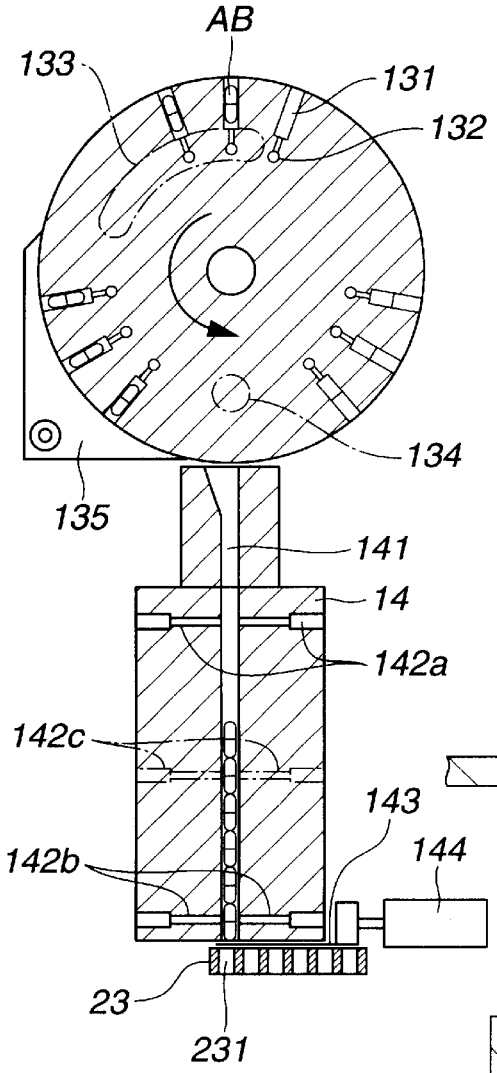
FIGS. 9A and 9B are sectional view showing a feeding drum and a magazine which form the supplying section.
Figure 9B:
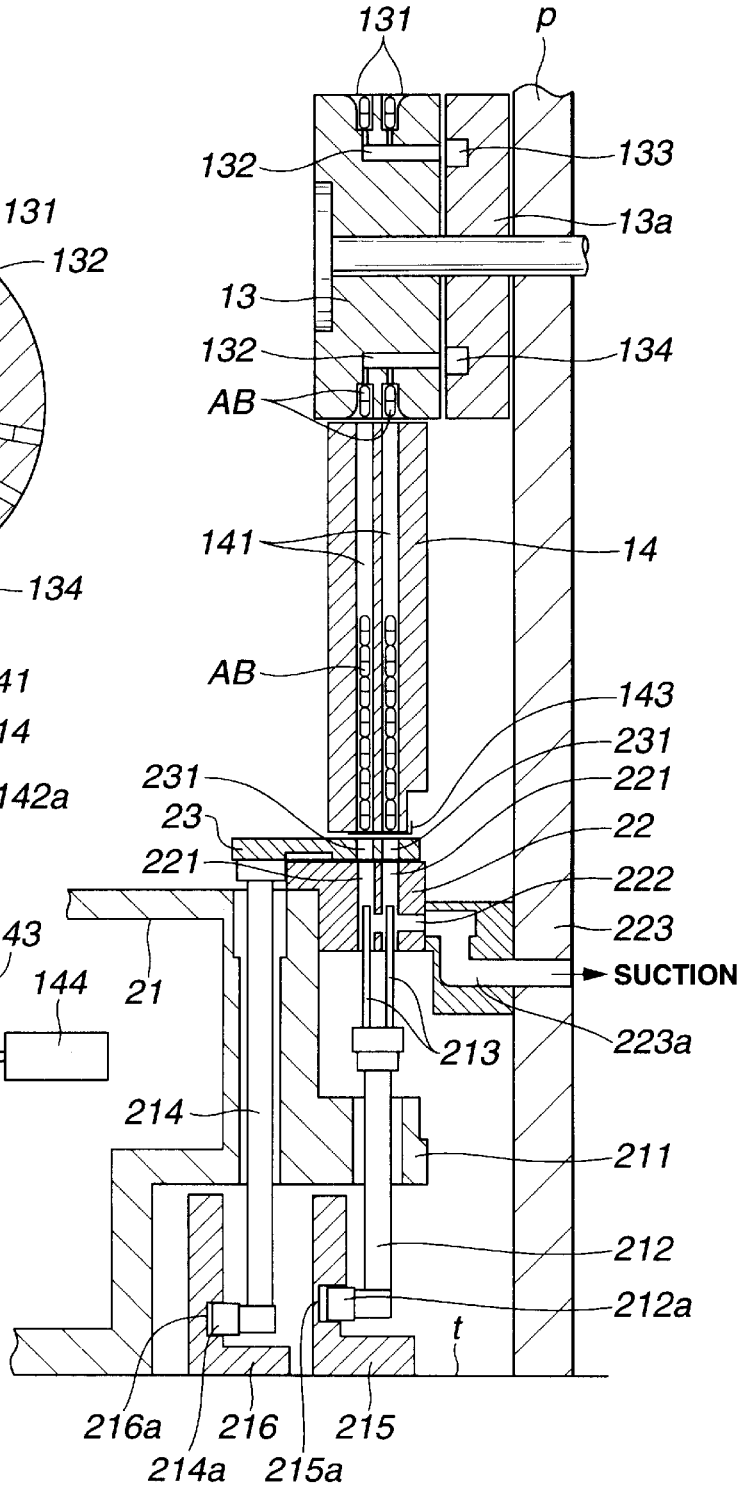

The feeding drum 13 is formed with a diameter smaller than that of the supply drum 11 similarly to the direction controlling drum 12 described hereinabove and is disposed below the direction controlling drum 12 in a condition wherein a circumferential face thereof is close to the direction controlling drum 12. The feeding drum 13 rotates in the opposite direction (counterclockwise direction FIG. 1) to that of the direction controlling drum 12 at a circumferential speed equal to that of the direction controlling drum 12. As shown in FIGS. 3, 9A and 9B, three sets of feeding sections, each set including totaling six feeding pockets 131 arranged in three rows by two columns are provided in an equally spaced relationship from each other in a circumferential direction on the circumferential face of the feeding drum 13 similarly as in the direction controlling drum 12.

Figure 10:
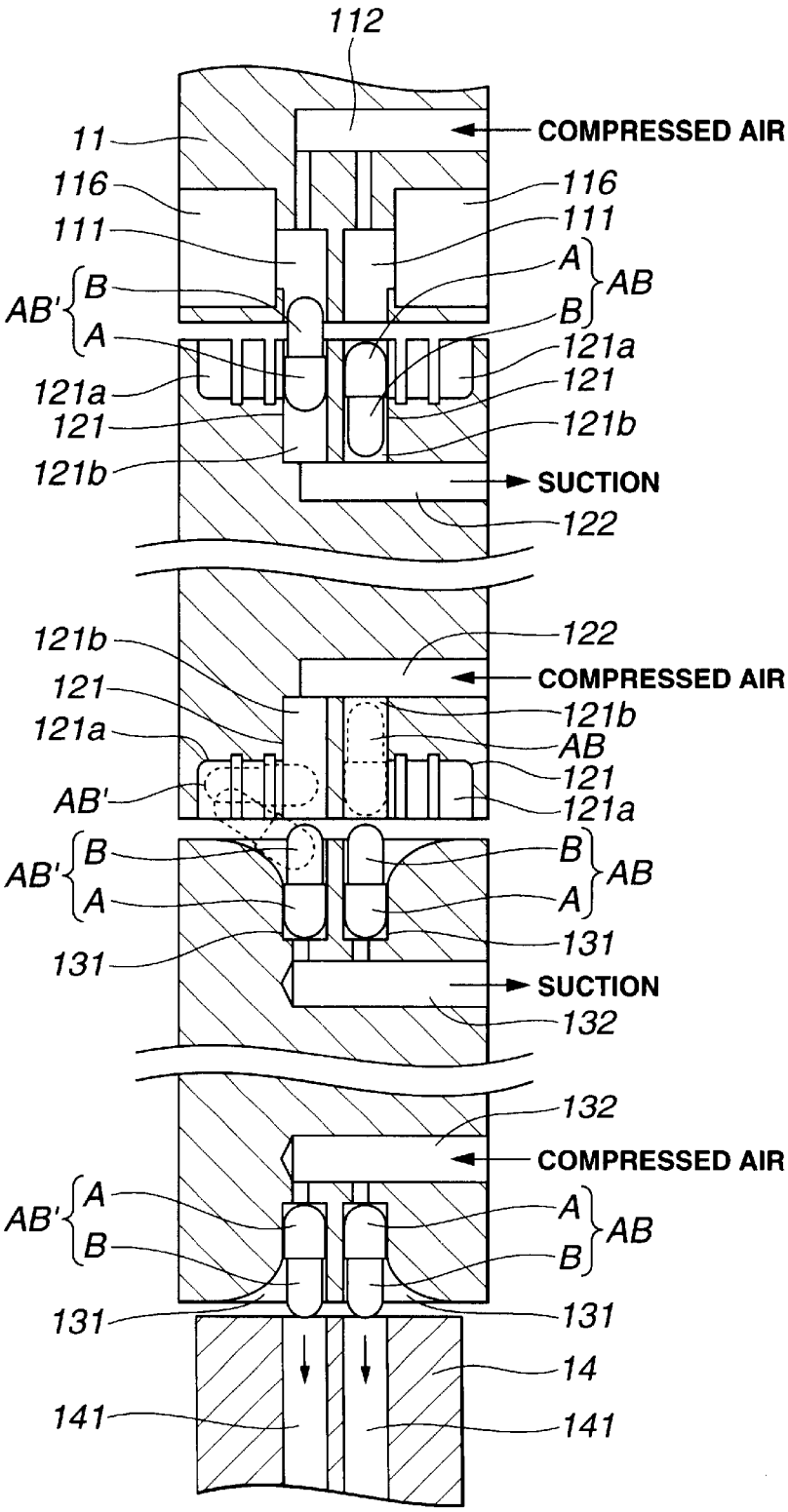
FIG. 10 is an explanatory view illustrating posture control of an empty capsule performed by the supplying section.

As shown in FIGS. 9A, 9B and 10, each of the feeding pockets 131 is formed in such a shape that an opening thereof is partly expanded in a widthwise direction of the feeding drum 13 so that a capsule may be introduced into the feeding pocket 131 readily, and is communicated with a suction/blowing out hole 132 formed in the feeding drum 13 in the proximity of the inner side in a diametrical direction. In particular, one suction/blowing out hole 132 is communicated with two feeding pockets 131, 131 juxtaposed with each other along a widthwise direction of the feeding drum 13 and is open to one side face of the feeding drum 13. Further, as shown in FIGS. 4, 9A and 9B, a third suction and exhaust block 13*a* is disposed between the feeding drum 13 and the column p on which the feeding drum 13 is supported in a similar manner as in the case of the supply drum 11 and the direction controlling drum 12. A suction path 133 and a compressed air path 134 are provided on the front face side (adjacent to the feeding drum 13) of the third suction and exhaust block 13*a* as shown in FIGS. 4, 9A and 9B. In a condition wherein the suction path 133 and the suction/blowing out hole 132 are registered with each other, a negative pressure acts inside the feeding pockets 131, but in another condition wherein the compressed air path 134 and the suction/blowing out hole 132 are registered with each other, air is blown into the feeding pockets 131. Further, as shown in FIGS. 1, 3 and 9A, a guide member 135 for preventing letting off of a capsule is provided along the circumferential face of the feeding drum 13 and extends from one side portion (left side portion in the figures) to the lower side of the circumferential face of the feeding drum 13.

The magazine 14 which can accommodate a predetermined number of empty capsules AB is disposed below the feeding drum 13. As shown in FIGS. 3, 9A and 9B, the magazine 14 has two capsule supply paths 141 each in the form of a hollow having a diameter a little greater than the outer diameter of the empty capsules AB. Empty capsules AB charged from the feeding drum 13 are accommodated once into the capsule supply paths 141 and aligned along a vertical direction in a vertically standing state in the capsule supply paths 141, and the empty capsules AB are successively supplied from the lower ends of the capsule supply paths 141 to the transport section 2.

The magazine 14 is disposed at a position in which, when a feeding pocket 131 passes by the guide member 135 and is opened downwardly as a result of rotation of the feeding drum 13, the top end opening of one of the capsule supply paths 141 is opposed to the opening of the feeding pocket 131. The capsule supply path 141 is formed in such a shape that the opening thereof is partly expanded toward the direction of rotation of the feeding drum 13 so that an empty capsule AB can advance into the capsule supply path 141 with certainty. Further, photoelectric sensors 142*a*, 142*b* formed from a pair of light emission and reception elements are disposed at a lower end portion and an upper portion of the magazine 14. The insides of the capsule supply paths 141 are normally supervised by the photoelectric sensors 142*a*, 142*b* to detect presence or absence of an empty capsule AB and the rough number of such empty capsules AB, and a shutter 143 (refer to FIGS. 9A and 9B) disposed at a lower end portion of the magazine 14 is opened or closed by an air cylinder 144 (refer to FIG. 9A) in response to a result of the detection.

Operation of the supplying section 1 is described with reference to FIGS. 3, 4 and 10. First, empty capsules AB accommodated in the hopper h are successively supplied to and accommodated into the supply pockets 111 of the supply drum 11. In this instance, when the supply drum 11 rotates in the counterclockwise direction in FIG. 3 and a pair of the supply pockets 111 pass the supplying location from the hopper h, one of the sucking/blowing out holes 112 communicated with the supply pockets 111 is registered with the suction path 113*a* so that the insides of the supply pockets 111 are acted upon by a negative pressure. Consequently, a pair of empty capsules AB are accommodated from the hopper h into the supply drum 11 with certainty by an attracting force by the negative pressure. In this instance, the empty capsules AB accommodated in the supply pockets 111 exhibit a condition wherein those in the erected state with the cap A directed upwardly and those in the inverted state with the body B directed upwardly are present in a mixed condition.

The capsules accommodated in the supply pockets 111 of the supply drum 11 are carried to the lower side of the supply drum 11 as the supply drum 11 rotates and are transferred to the direction controlling pockets 121 of the direction controlling drum 12. Thereupon, one of the sucking/blowing out holes 112 which is communicated with a pair of supply pockets 111 is registered with the compressed air path 115 (refer to FIGS. 3 and 4) and one of the suction/blowing out holes 122 which is communicated with a pair of direction controlling pockets 121 is registered with the suction path 123 (refer to FIGS. 3 and 4). Consequently, as shown in FIG. 10, air is blown out from the supply pockets 111 to force out the accommodated empty capsules AB while the direction controlling pockets 121 are brought into a sucking condition so that the empty capsules AB are received with certainty.

Here, while the total number 42 of supply pockets 111 arranged in 21 rows by 2 columns are provided uniformly on the circumferential face of the supply drum 11, only the three sets of direction controlling sections, each set including the totaling six direction controlling pockets 121 arranged in three rows by two columns, are provided in an equally spaced relationship from each other in the circumferential direction on the direction controlling drum 12. Therefore, empty capsules AB accommodated in the supply pockets 111 of the supply drum 11 are successively transferred six by six of three rows by two columns to the direction controlling drum 12. Thus, empty capsules AB supplied from the hopper h to the supply drum 11 are not transferred from the supply drum 11 to the direction controlling drum 12 during a first one rotation of the supply drum 11, and after they pass by the supplying location from the hopper h, they are transferred to the direction controlling drum 12 during a second one rotation. Accordingly, even if an empty capsule AB is not successfully accommodated into one of the supply pockets 111 upon supplying of empty capsules AB from the hopper h and the supply pocket 111 remains empty, when the supply pocket 111 passes by the supplying location from the hopper h for the second time, an empty capsule AB is accommodated into the empty pocket. Consequently, empty capsules AB are supplied to the direction controlling drum 12 with certainty while an empty direction controlling pocket 121 does not appear on the direction controlling drum 12.

Further, since each empty capsule AB is composed of the cap A and the body B which are temporarily coupled to each other such that they can be separated from each other readily, the cap A and the body B are liable to be separated, and caps A and bodies B of empty capsules AB separate from each other are sometimes present in the hopper h. If such a cap A or body B is accommodated solely into a supply pocket 111 of the supply drum 11, then the cap A or body B accommodated solely in the supply pocket 111 is removed at a location at which a brush roller b is disposed (refer to FIGS. 3 and 4) immediately after it passes the capsule supplying location from the hopper h.

In particular, as shown in FIGS. 3 and 4, at the location of the brush roller b, the capsule discharging space portion 116 communicated with the supply pockets 111 is registered with the suction path 114*a* of the first suction and exhaust block 11*a* or the suction path 114*b* of the small suction block 11*b* and a negative pressure acts in the supply pockets 111. At this time, if a body B is accommodated solely in one of the supply pockets 111, for example, as shown in FIG. 6B, then the body B is sucked by a sucking force of the negative pressure from the suction path 114*a* (or 114*b*) through a capsule discharging window 116*a* provided at the lower portion of the supply pocket 111 into the capsule discharging space portion 116 in a rolling condition and discharged and removed from the supply pocket 111. In this instance, as shown in FIG. 6B, since an empty capsule AB composed of a cap A and a body B coupled to each other has a greater length than the sole cap A or the sole body B, it cannot roll from the supply pocket 111 into the capsule discharging window 116*a* and will not be sucked out of the supply pocket 111 to the capsule discharging space portion 116.

In this manner, when only the cap A or only the body B is accommodated into a supply pocket 111, the cap A or the body B is removed immediately. Thus, empty capsules which are transported by the supply drum 11 and transferred to the direction controlling drum 12 are only empty capsules AB composed of the cap A and the body B temporarily coupled to each other whereas the sole cap A or the sole body B is prevented from being transferred to the direction controlling drum 12. It is to be noted that, since transfer of empty capsules from the supply pockets 111 to the direction controlling pockets 121 is not performed during. the first rotation of the supply drum 11 but is performed during the second rotation of the supply drum 11 as described hereinabove, into a supply pocket 111 which is in an empty state because only the cap A or only the body B has been accommodated into and then removed from it, an empty capsule AB is accommodated when it passes the supplying location from the hopper h, and the empty capsule AB is transferred to the direction controlling drum 12.

Then, as shown in FIG. 10, each empty capsule AB which has advanced with the body B side directed forwardly and been accommodated into a direction controlling pocket 121 of the direction controlling drum 12 is accommodated fully in the direction controlling pocket 121 in an erected state with the cap A thereof directed upwardly (adjacent to the circumferential face of the drum) and with the body B thereof advanced to the bottom portion 121*b* of the direction controlling pocket 121. Meanwhile, each empty capsule AB' which has advanced with the cap A side directed forwardly and been accommodated into a direction controlling pocket 121 of the direction controlling drum 12 cannot advance to the bottom portion 121*b* because the diameter of the cap A is greater than the diameter of the bottom portion 121*b*, and is held in the direction controlling pocket 121 in a state wherein the body B portion projects from the circumferential face of the direction controlling drum 12. As the direction controlling drum 12 rotates in this state, the body B portion projecting from the circumferential face of the drum advances into a V-shaped groove 127 (refer to FIG. 7B) of the direction controlling guide member 126 and is engaged with a side edge portion of the direction controlling protrusion 127*a* (refer to FIG. 7B). As the direction controlling drum 12 further rotates, the body B side of the empty capsule AB' is pressed outwardly in a widthwise direction of the direction controlling drum 12 so that it is fallen down into the upper portion 121*a* of the direction controlling pocket 121 around a fulcrum provided by the end of the cap A. Consequently, the empty capsule AB' is accommodated into and held in the upper portion 121*a* of the direction controlling pocket 121 in a horizontally lying state along a widthwise direction of the direction controlling drum 12. In this manner, the empty capsule AB' accommodated in a horizontally lying state in the upper portion 121*a* of the direction controlling pocket 121 has the cap A portion thereof positioned on the bottom portion 121*b* of the direction controlling pocket 121 and has the body B side directed to the outer side.

Then, the empty capsules AB and AB' accommodated in the direction controlling pockets 121 of the direction controlling drum 12 in this manner are transferred to the feeding pockets 131 of the feeding drum 13 as shown in FIG. 10. Also in this instance, the suction/blowing out hole 122 communicated with the direction controlling pockets 121 is registered with the compressed air path 124 (refer to FIGS. 3 and 4) and the suction/blowing out hole 132 communicated with the feeding pockets 131 is registered with the suction path 133 (refer to FIGS. 3 and 4). Consequently, as shown in FIG. 10, air is blown out from the bottom portions 121*b* of the direction controlling pockets 121 to force out the empty capsules AB and AB' accommodated in the direction controlling pockets 121 while the feeding pockets 131 are put into an attracting condition to receive the empty capsules AB with certainty.

At this time, as shown in FIG. 10, the empty capsules AB having been accommodated in the direction controlling pockets 121 in an erected state with the body B portions thereof advanced to the bottom portions 121*b* of the direction controlling pockets 121 are advanced as they are into the feeding pockets 131 with the cap A sides thereof directed forwardly and are accommodated in an inverted state with the body B sides thereof directed upwardly (adjacent to the drum circumferential face side). Meanwhile, as indicated by broken lines in FIG. 10, an empty capsule AB' accommodated in the horizontally lying state at the upper portion 121*a* of a direction controlling pocket 121 is pushed out to a feeding pocket 131 with the cap A directed forwardly by air blown out from the bottom portion 121*b* of the direction controlling pocket 121 and is sucked into the feeding pocket 131 with the cap A directed forwardly. Consequently, the empty capsule AB' is advanced into the feeding pocket 131 with the cap A directed forwardly until it is accommodated in an inverted state with the body B directed upwardly (adjacent to the drum circumferential face). Accordingly, the empty capsules AB and AB' transferred to the feeding drum 13 are all accommodated in an inverted state with the bodies B thereof directed upwardly in the feeding pockets 131.

Here, when each of the empty capsules AB is transferred from a supply pocket 111 of the supply drum 11 into a direction controlling pocket 121 of the direction controlling drum 12, even if it is in an erected state wherein it advances into the direction controlling pocket 121 with the body B directed forwardly, it sometimes occurs by some reason that it is accommodated into the upper portion 121*a* of the direction controlling pocket 121 in a reversely horizontally lying state wherein the cap A is directed to the outside or the cap A portion of the empty capsule AB projects from the circumferential face of the drum in an erected state with the cap A directed upwardly and the empty capsule AB is laid down horizontally by the direction controlling guide member 126 into a reverse-horizontally lying state wherein the cap A is directed to the outside. If such a reverse-horizontally lying capsule as just described is transferred to a feeding pocket 131 of the feeding drum 13 from the body B side, then the empty capsule in an erected state with the cap A directed upwardly is mixed in empty capsules which are held in the feeding drum 13 on which all empty capsules must be in an inverted state with the bodies B thereof directed upwardly.

Therefore, in the filling machine of the present embodiment, such a reverse-horizontally lying capsule is not transferred from the direction controlling drum 12 to the feeding drum 13, but is recovered and removed from the direction controlling drum 12.

In particular, while the reverse-horizontally lying capsule is accommodated in the upper portion 121*a* of a direction controlling pocket 121 in a condition wherein the cap A side thereof is directed to the outside of the direction controlling drum 12, since the upper portion 121*a* of the direction controlling pocket 121 is formed as a reduced width portion the width W of an outer side portion of which is smaller than the diameter of the cap A as shown in FIG. 8B, the reverse-horizontally lying capsule is pressed by the direction controlling guide member 126 (refer to FIG. 3) so that it is put into a condition wherein it is confined to the reduced width portion of the upper portion 121*a* of the direction controlling pocket 121 and cannot be pulled out readily from the direction controlling pocket 121. Consequently, also upon transfer from the direction controlling drum 12 to the feeding drum 13, the reverse-horizontally lying capsule does not move to a feeding pocket 131 of the feeding drum 13, but passes the transfer location and is further transported while it is held in the upper portion 121*a* of the direction controlling pocket 121. Then, the reverse-horizontally lying capsule is scraped out from the upper portion 121*a* of the direction controlling pocket 121 by the scraper 128 (refer to FIG. 7A) inserted in one of the scraper insertion grooves 125 (refer to FIG. 8) which extends across the upper portion 121*a* of the direction controlling pocket 121 and is recovered into the recovery can 128*b*.

The empty capsules AB and AB' in an erected state transferred from the direction controlling drum 12 to the feeding drum 13 in such a manner as described above move to the lower side as the feeding drum 13 rotates, and are charged into the capsule supply paths 141, 141 of the magazine 14 disposed below the feeding drum 13 from the body B side with the bodies B thereof directed forwardly as shown in FIG. 10. Consequently, a predetermined numbers of empty capsules AB and AB' are reserved once in a condition wherein they are registered in a vertical direction in an upright state and are successively loaded into the capsule pockets of the transport section 2 hereinafter described from the lower end openings of the capsule supply paths 141, 141.

In this instance, as shown in FIGS. 9A and 9B, the lower end opening of each of the capsule supply paths 141 of the magazine 14 is closed by the shutter 143 when the filling machine is activated, and at a point of time when the predetermined number of empty capsules AB are reserved in the capsule supply paths 141 and detected by the photoelectric sensor 142*a* on the upper side and it is confirmed that the predetermined number of empty capsules AB are reserved, the air cylinders 144 operate to open the shutters 143 to start a loading operation of the empty capsules AB into the transport section 2.

Here, the feeding pockets 131 provided on the feeding drum 13 are disposed such that three sets of feeding pocket groups, each set including totaling six feeding pockets 131 arranged in three rows by two columns as described above are spaced by an equal distance from each other, although the feeding drum 13 continuously rotates at a fixed speed, charging of empty capsules AB into the capsule supply paths 141 of the magazine 14 from the feeding drum 13 is performed such that an operation of charging, after totaling six empty capsules arranged in three rows by two columns are successively thrown in, next six empty capsules continuously after a predetermined time is repeated. Thus, successive charging is repeated intermittently. On the other hand, supplying of empty capsules from the lower end openings of the capsule supply paths 141 of the magazine 14 into the transport section 2 is performed successively. Consequently, supplying of empty capsules AB to the transport section 2 is performed while increasing and decreasing of the number of empty capsules AB reserved in the capsule supply paths 141 of the magazine 14 are repeated.

Further, if, because an empty capsule in a reverse-horizontally lying state described above appears frequently and an empty feeding pocket 131 appears comparatively frequently on the feeding drum 13 as a result of removal of the empty capsule or from some other reason, the balance between the charging rate of empty capsules AB from the feeding drum 13 into the magazine 14 and the empty capsule supplying rate into the transport section 2 from the magazine 14 is lost and the number of empty capsules AB reserved in the capsule supply paths 141 of the magazine 14 decreases thereby to make any one of the capsule supply paths 141 empty, then this is detected by the photoelectric sensor 142*b* on the lower side. Consequently, the shutters 143 (refer to FIG. 9A) are closed to stop supplying of empty capsules AB into the transport section 2 and operations after supplying of empty capsules such as transportation of empty capsules by the transport section 2, separation, filling of contents substance, coupling and discharging are all stopped. Then, at a point of time when the predetermined number of empty capsules are reserved into the capsule supply paths 141 of the magazine 14 again, this is detected by the photoelectric sensor 142*a* on the upper side. Consequently, the shutters 143 are opened to resume supplying of empty capsules to the transport section 2, and the operations following the supplying of empty capsules are resumed simultaneously to resume the capsule filling operation.

Here, although not employed in the present embodiment, it is otherwise possible to provide a third photoelectric sensor 142*c* at an intermediate portion of the magazine 14 in the vertical direction as indicated by an alternate long and short dash line in FIG. 9A and additionally provide a spare magazine (not shown) positioned on the upstream side of the location of the magazine 14 in the transporting direction of the transport section 2 for supplying empty capsules temporarily in place of the magazine 14 when empty capsules in the magazine 14 decrease so that the number of times of stopping the filling operation is decreased. In particular, when the number of empty capsules AB in the magazine 14 decreases further than a predetermined number, this is detected by the third photoelectric sensor 142*c* and a shutter of the spare magazine is opened so that spare empty capsules accommodated in an erected state in advance in the spare magazine are supplied to the transport section 2 on the upstream side with respect to the magazine 14 in place of the magazine 14. In this instance, supplying of empty capsules AB from the magazine 14 is temporarily stopped since the spare empty capsules are already accommodated in the capsule pockets of the transport section 2, and at a point of time when a predetermined number of empty capsules AB are reserved into the magazine 14 again and this is detected by the upper side photoelectric sensor 142*a*, the shutter of the spare magazine is closed to stop the supplying of empty capsules from the spare magazine while supplying from the magazine 14 is resumed. Then, only after spare capsules in the spare magazine are used up and also empty capsules AB in the magazine 14 are used up, the filling operation is stopped by the operation described above. Consequently, the number of times of the filling operation can be reduced and filled capsule products can be produced more efficiently.

The transport section 2 described above receives empty capsules AB from the magazine 14, transports them, and, during the transportation, separates each of the empty capsules once into the cap A and the body B, couples the cap A and the body B to each other after contents substance is filled into the body B by the filling section 3 which is hereinafter described, and carries out the capsules to the outside of the filling machine. The transport section 2 includes a turntable 21 disposed such that an upper face thereof is close to the lower end of the magazine 14 as shown in FIGS. 1 and 2.

The turntable 21 is driven by a driving source (not shown) disposed in the platform t to constantly rotate at a predetermined speed in the counterclockwise direction in FIG. 2. A body disk (body transport member) 22 and twenty-four cap segments (cap transport members) 23 are mounted on the turntable 21.

Figure 11A:
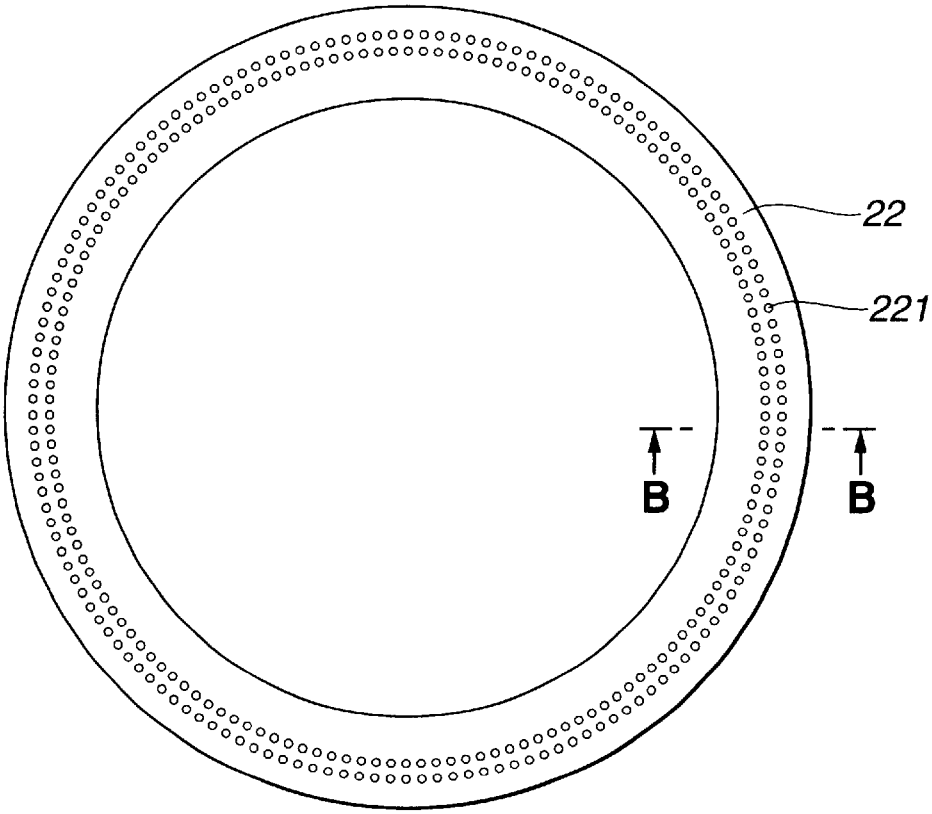
FIG. 11A is a plan view showing a body disk which forms a transport section of the capsule filling machine.
Figure 11B:
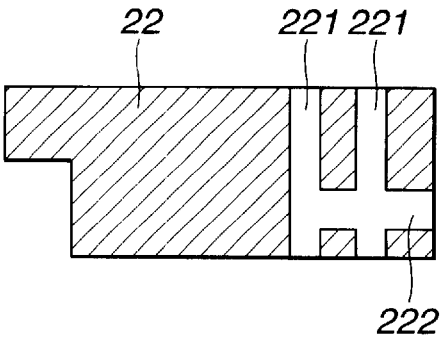
FIG. 11B is a sectional view taken along line B—B of FIG. 11A.
Figure 13A:
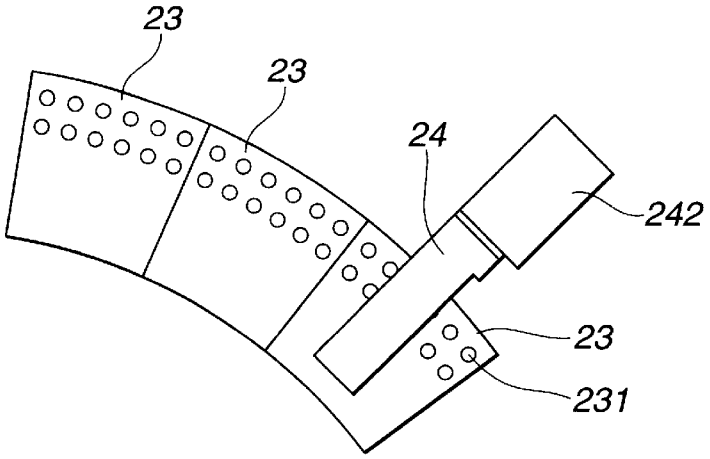
FIG. 13 is a plan view showing a location of a separation failure detector provided in the transport section and FIG. 13-B is a sectional view showing the location.
Figure 13B:
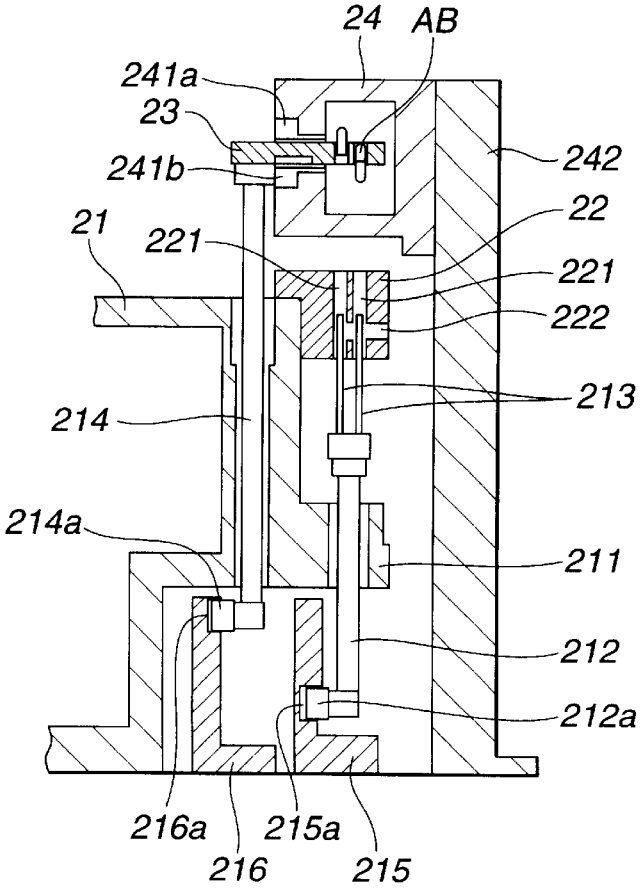

The body disk 22 is in the form of a thick ring plate as shown in FIGS. 11A and 11B and is secured on a circumferential edge portion at an upper end of the turntable 21 such that it projects to the outside as shown in FIGS. 9B and 13B. As shown in FIGS. 11A and 11B, 288 body pockets 221 are formed in two rows along a circumferential direction in the body disk 22 such that they extend upwardly and downwardly through the body disk 22. Further, as shown in FIG. 11B, a suction path 222 communicated with each set of two body pockets 221 juxtaposed with each other in a radial direction of the body disk 22 is formed in the radial direction in the body disk 22 and is open to an outer circumferential face of the body disk 22. The openings of the suction paths 222 are registered with suction holes 223*a* of a suction block 223 mounted on the column p as shown in FIG. 9B so that a negative pressure acts in the body pockets 221 through the suction path 222 at the position immediately below the magazine 14.

Further, as shown in FIGS. 1, 9B and 13B, a flange 211 projecting outwardly is provided on an outer circumferential face of an intermediate portion of the turntable 21 in a vertical direction (thicknesswise direction). As shown in FIGS. 9B and 13B, an upper end portion of a plunger pin 213 which projects upwardly from an upper end of a first lift member 212 mounted for upward and downward movement on the flange 211 is inserted in a body pocket 221 such that an upper end face of the plunger pin 213 forms the bottom face of the body pocket 221. Though not particularly shown, the first lift member 212 has 12 of such plunger pins 213 provided uprightly in 6 rows by 2 columns thereon, and 24 of such first lift members 212 each having 12 of plunger pins 213 in this manner are disposed corresponding to the 24 of cap segments 23 described hereinabove.

Figure 12A:
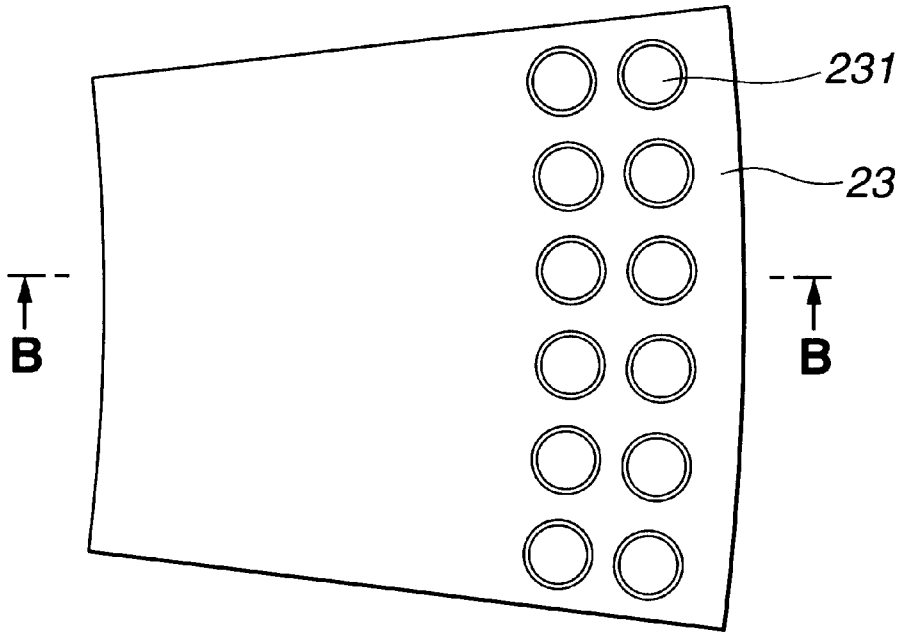
FIG. 12A is a plan view showing a cap segment which forms the transport section and FIG. 12B is a sectional view taken along line B—B of FIG. 12A.
Figure 12B:
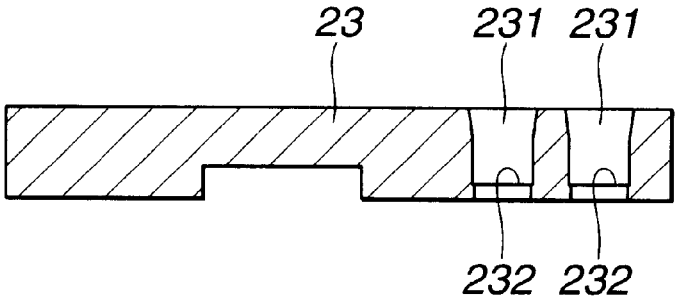

Meanwhile, as shown in FIGS. 12A and 12B, each of the 24 cap segments 23 is in the form of a plate of a substantially sectorial shape having a small opening angle and has 12 cap pockets 231 provided in 6 rows by 2 columns along a circumferential direction on an outer peripheral portion thereof. The cap pockets 231 are through-holes which extend upwardly and downwardly through the cap segments 23 as shown in FIG. 12B and are each formed with a rather small diameter at a lower end portion thereof so as to form an offset 232 on an inner circumferential wall at the lower end thereof so that it allows the body B portion of an empty capsule AB to pass therethrough but does not allow the cap A portion to pass therethrough.

The cap segments 23 are secured to upper end portions of 24 second lift members 214 mounted for upward and downward movement on a circumferential edge portion of the turntable 21 as shown in FIGS. 9B and 13B. The cap segments 23 are moved upwardly and downwardly by upward and downward movement of the second lift members 214 in a condition wherein the cap pockets 231 are registered with the body pockets 221 of the body disk 22 in the upward and downward directions.

Here, as shown in FIGS. 9B and 13B, cam followers 212*a* and 214*a* are provided at lower end portions of the first lift members 212 and the second lift members 214, respectively, and are fitted for sliding movement in cam grooves 215*a* and cam groove 216*a* of guide walls 215 and 216 provided uprightly on the platform t, respectively. The body disk 22, first lift members 212, cap segments 23 and second lift members 214 rotate together with the turntable 21. In this instance, the cam followers 212*a* and 214*a* of the first lift member 212 and the second lift members 214 slidably move and remain fitted in the cam grooves 215*a* and cam groove 216*a* of the guide walls 215 and 216, respectively, and the first lift members 212 and the second lift members 214 are moved upwardly and downwardly under the guidance of the cam grooves 215*a* and cam groove 216*a* thereby to upwardly and downwardly move the plunger pins 223 and the cap segments 23, respectively.

The transport section 2 accommodates empty capsules AB in an erected state supplied from the magazine 14 of the supplying section 1 into the capsule pockets formed from the cap pockets 231 of the cap segments 23 and the body pockets 221 of the body disk 22, separates each of the empty capsules AB immediately after the accommodation into the caps A and the bodies B and holds them in the cap pockets 231 and the body pockets 221, transports the caps A and the bodies B by rotation of the cap segments 23 and the body disk 22, inspects for separation failure by means of a separation failure detector 24 (refer to FIG. 2) during transportation of the caps A and the bodies B, fills substance contents into the bodies B by the filling section 3, couples the caps A and the bodies B at the location of a holding down plate 41 (refer to FIG. 2) and a coupling roller 42 (refer to FIG. 2), discharges resulting filled capsule products C through a discharging chute 5 (refer to FIG. 2), cleans the insides of the body pockets 221 and the cap pockets 231 by means of a cleaner 6 (refer to FIG. 2), and receives supply of empty capsules AB from the supplying section 1 again so that similar operations are repeated.

The separation failure detector 24 includes, as shown in FIG. 13B, a pair of photoelectric sensors 241*a* and 241*b* disposed above and below a cutaway portion of a frame member having a cross section of a substantially inverted C-shape as shown in FIG. 13B, and is mounted at an upper end portion of a post 242 provided uprightly on the platform t and disposed above the body disk 22.

Figure 14A:
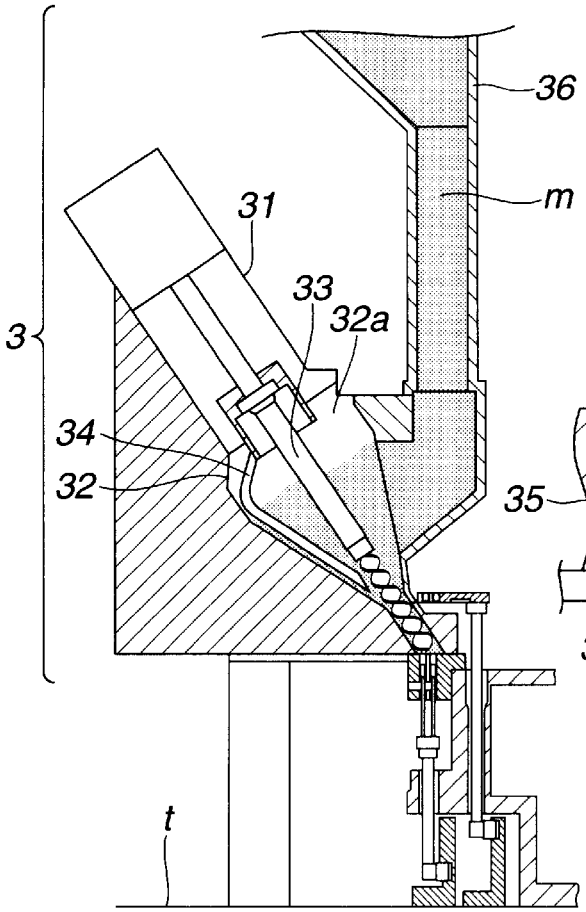
FIG. 14A is a schematic sectional view showing a filling section of the capsule filling machine and FIG. 14B is a partial enlarged sectional view of the filling section.

Further, the filling section 3 includes, as shown in FIG. 1, a contents substance filling unit 31 for force feeding contents substance m such as medicine or foods to be filled into empty capsules AB onto the body disk 22, and a hopper 36 for supplying the contents substance to the contents substance filling unit 31. The contents substance filling unit 31 has, as shown in FIG. 14A and B of FIG. 14, a chamber 32 having a such a shape that two hollows 32*a*, 32*a* of a substantially funnel-shape are juxtaposed and communicated with each other (refer to FIG. 2). A force feeding screw 33 and an agitating arm 34 which is bent substantially in an L-shape along an inner circumferential face of each of the hollows 32*a* are disposed in each of the hollows 32*a*, 32*a* of the chamber 32. The force feeding screws 33 are rotated at a predetermined speed by a driving source (not shown) disposed in the platform t and the agitating arms 34 are revolved at a predetermined speed around the force feeding screws 33.

Figure 14B:
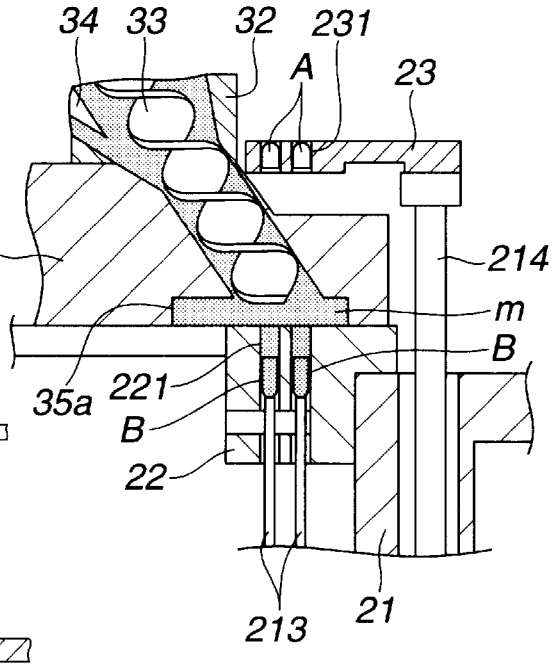

Meanwhile, as shown in FIG. 14B, a contents substance filling block 35 is disposed at the location of the contents substance filling unit 31 between the body disk 22 and a cap segment 23 which is at its upper limit position. The contents substance filling block 35 is in a state almost in contact with the upper face of the body disk 22, and a recess is formed on a lower face of the contents substance filling block 35 such that it covers over the body pockets 221 and the inside of the recess serves as a contents substance filling chamber 35*a*. Further, an end of the chamber 32 of the contents substance filling unit 31 extends obliquely from the outer side of the body disk 22 in a radial direction and is connected to the contents substance filling block 35 such that the hollows 32*a* of the chamber 32 are communicated with the contents substance filling chamber 35*a*.

The contents substance filling unit 31 agitates contents substance m continuously supplied into the chamber 32 from the hopper 36 by means of the agitating arms 34 and force feeds the contents substance m to the contents substance filling chamber 35*a* by rotation of the force feeding screws 33 so that the contents substance m is force fed into the bodies B accommodated in the body pockets 221 of the body disk 22.

The holding down plate 41 is disposed in a neighboring relationship to a cap segment 23 in a state placed on the body disk 22 such that the tops of the cap pockets 231 formed in the cap segments 23 are closed up with the holding down plate 41. Meanwhile, the coupling roller 42 is disposed for rotation in a state almost contacting with the cap segments 23 in a state placed on the body disk 22 such that it is rotated by rotation of the cap segments 23 and rolled on the cap pockets 231 of the cap segments 23.

As shown in FIG. 2, the discharging chute 5 includes a recovery section 51 in the form of a rectangular frame curved arcuately, and a discharging pipe 52 connected to a trailing end portion (end portion on the downstream side in the transporting direction, this similarly applies to the following description) of the recovery section 51. An open lower face of the recovery section 51 is positioned in the proximity of an upper face of a cap segment 23 in a state placed on the body disk 22, and the discharging pipe 52 is inclined downwardly and extends to the outside of the apparatus. A changeover flap 53 for changing over a discharging flow path is disposed for swinging movement in the discharging pipe 52. The discharging chute 5 thus accommodates filled capsule products C discharged from the capsule pockets composed of the cap pockets 231 and the body pockets 221 onto the cap segments 23 once into the recovery section 51, throws the filled capsule products C accommodated in the recovery section 51 into the discharging pipe 52 by compressed air jetted from a compressed air jetting section (not shown) disposed at a rear end portion of the recovery section 51, and discharges the filled capsule products C to the outside of the apparatus through the discharging pipe 52. In this instance, if a failed capsule not separated completely is detected by the separation failure detector 24, then the changeover flap 53 is swung at a timing of discharging of the failed capsule to change over the discharging path.

Further, the cleaner 6 is a vacuum cleaner disposed in a state neighboring a cap segment 23 placed on the body disk 22 and sucks contents substance and so forth remaining in the cap pockets 231 and the body pockets 221 to clean the insides of the pockets 231 and 221.

Subsequently, operation until filled capsule products are obtained when empty capsules AB charged into the cap pockets 231 of the cap segments 23 and the body pockets 221 of the body disk 22 of the transport section 2 from the magazine 14 are transported by rotation of the cap segments 23 and the body disk 22 and filled with contents substance is described with reference to FIG. 15.

Figure 15:
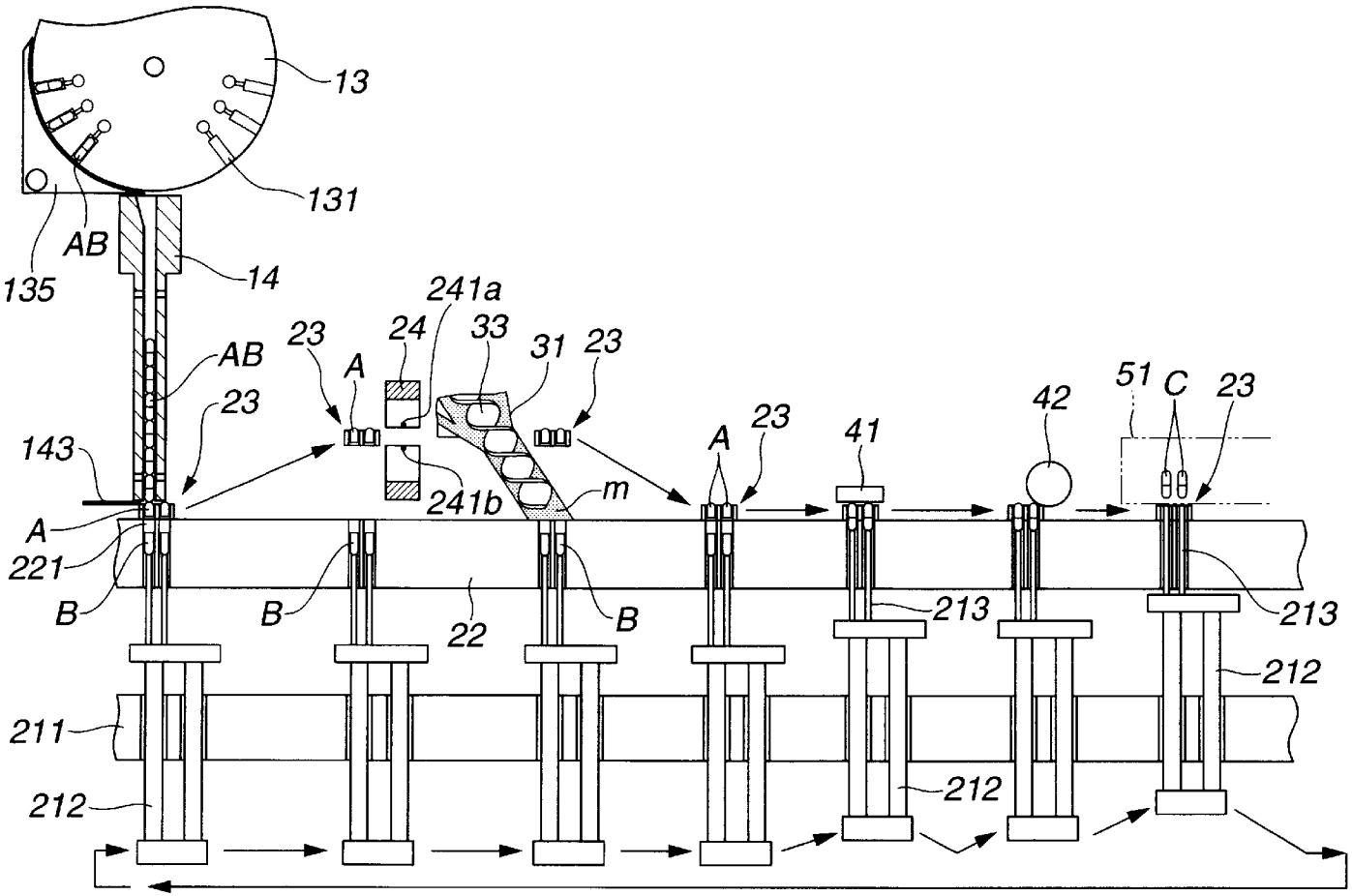
FIG. 15 is an explanatory view successively illustrating a contents substance filling operation by the capsule filling machine.

Empty capsules AB accommodated in an erected state in the magazine 14 by posture control by the supplying section 1 are charged into the capsule pockets formed from of the cap pockets 231 and the body pockets 221 from the lower end of the magazine 14 as shown in FIG. 15. In particular, in the empty capsule charging location, a cap segment 23 is at its lower limit at which it contacts with the body disk 22 and capsule pockets are formed from the cap pockets 231 and the body pockets 221, and the empty capsules AB are charged from the body B side thereof in an erected state into the capsule pockets.

At this time, as shown in FIG. 9B, the suction paths 222 of the body disk 22 are registered with the suction holes 223*a* of the suction block 223 and a negative pressure acts in the body pockets 221 through the suction paths 222, and the empty capsules AB are accommodated from the magazine 14 into the capsule pockets formed from the cap pockets 231 and the body pockets 221 with certainty by a sucking force of the negative pressure. Further, since the offset 232 (refer to FIG. 12B) through which the body B of an empty capsule AB can pass but the cap of it cannot pass is provided at the lower end portion of each of the cap pockets 231, the caps A are left in the cap pockets 231 while only the bodies B are moved to the bottoms of the body pockets 221 passing through the offsets 232 by the sucking force of the negative pressure. Consequently, the empty capsules AB are separated into the caps A and the bodies B, which are accommodated and held in the cap pockets 231 and the body pockets 221, respectively.

The caps A and the bodies B separated from each other in this manner are transported to the location of the filling section 3 by rotation of the cap segment 23 and the body disk 22. At this time, as shown in FIG. 15, the cap segment 23 moves upwardly together with the second lift member 214 (refer to FIGS. 9B and 13B) which moves upwardly under the guidance of a cam groove 216*a*, and passes in the separation failure detector 24, whereupon failure in separation of the cap A and the body B is inspected for. In particular, if the separation operation described above is not performed normally and the cap A and the body B remain in a coupled condition, then the body B portion of the empty capsule AB projects from the lower face of the cap segment 23 as shown in FIG. 13B, and this is detected by the photoelectric sensor 241*b* on the lower side. On the other hand, an empty capsule which is not regularly controlled in posture by some reason and is supplied in an inverted state with the body B directed upwardly or a double-cap capsule (an empty capsule on which two caps are provided in an overlapping relationship) exhibits a state wherein it projects from the upper face of the cap segment 23, and this is detected by the photoelectric sensor 241*a* on the upper side.

Consequently, mixture of an empty capsule or a double-cap capsule in final products is prevented.

Meanwhile, the bodies B accommodated in the body pockets 221 pass below the separation failure detector 24 and filled with a predetermined amount of contents substance at the location of the transport section 2.

In particular, as shown in FIGS. 14A and 14B, while the body pockets 221 in which the bodies B are accommodated pass below the contents substance filling chamber 35*a* communicated with the chamber 32 of the contents substance filling unit 31, as contents substance m is force fed from the chamber 32 of the contents substance filling unit 31 into the contents substance filling chamber 35*a* as described above, the contents substance m is force fed into the body pockets 221 at a predetermined pressure from the contents substance filling chamber 35*a* and filled into the bodies B. It is to be noted that a cap segment 23 on which the cap A is held passes above the contents substance filling block 35 on which the contents substance filling chamber 35*a* is provided as shown in FIGS. 14-B and 15. The filled amount of the contents substance into the body B can be adjusted based on the speed of rotation and the helix angle of the force feeding screws 33 of the contents substance filling unit 31, the speed of rotation of the turntable 21, the height of the plunger pins 213 and so forth.

After the location of the transport section 2 is passed, the cap segment 23 moves down together with the second lift member 214 (refer to FIGS. 9B and 13B) which moves downwardly under the guidance of the cam groove 216*a* until the cap segment 23 contacts in an overlapping relationship with the body disk 22 as shown in FIG. 15. Then, when the cap segment 23 passes below the holding down plate 41, the first lift member 212 on which the plunger pins 213 are mounted moves upwardly under the guidance of the cam groove 215*a*. Thereupon, the bodies B in which the contents substance is filled are pushed up by the plunger pins 213 until they are temporarily coupled to the caps A held down by the holding down plate 41. Then, after the plunger pins 213 move down, they move up again until the ends of the caps A project a little above the cap segment 23. When the caps A in this state pass below the coupling roller 42, they are pushed down by the coupling roller 42 so that the caps A and the bodies B are coupled completely to each other thereby to produce filled capsule products C.

Then, the cap pockets 231 and the body pockets 221 in which the filled capsule products C are accommodated move to the location of the discharging chute 5. Thereupon, as shown in FIG. 15, the first lift member 212 on which the plunger pins 213 are mounted further moves up under the guidance of the cam groove 215*a*, whereupon the filled capsule products C are pushed up by the plunger pins 213 until they are pushed out from the capsule pockets composed of the cap pockets 231 and the body pockets 221 onto the cap segment 23 and accommodated into the recovery section 51 of the discharging chute 5. Then, at a trailing end portion of the recovery section 51, the filled capsule products C are charged into the discharging pipe 52 (refer to FIG. 2) by air jetted from the compressed air jetting section (not shown) and are discharged to the outside of the apparatus through the discharging pipe 52. Thereupon, if a failed capsule not separated frequently is detected by the separation failure detector 24, then the changeover flap 53 is switched in a timed relationship with discharging of the failed capsule as indicated by an alternate long and short dash line in FIG. 2 to change over the discharging path to separately recover such failed capsules.

After the filled capsule products C are discharged, the plunger pins 213 move down to their initial condition and the insides of the cap pockets 231 and the body pockets 221 are cleaned by the cleaner 6 (refer to FIG. 2). Then, empty capsules AB are supplied from the magazine 14 of the supplying section 1 and similar operations are repeated. Consequently, filled capsule products C are produced fully automatically and continuously.

In this manner, the capsule filling machine of the present embodiment successively supplies empty capsules AB each composed of the cap A and the body B temporarily coupled to each other while the posture of them is controlled in an erected state with the cap A directed upwardly, accommodates and transports the empty capsules AB into and in the capsule pockets formed from the cap pockets 231 of the cap segments 23 and the body pockets 221 of the body disk 22, separates, during transportation of the empty capsules AB, the empty capsules AB into the caps A and the bodies B, holds the caps A in the cap pockets 231 while holding the bodies B in the body pockets 221, fills contents substance such as medicine or foods into the bodies B accommodated in and held by the body pockets 221 by means of the contents substance filling unit 31 disposed on the body disk 22, and couples the bodies B to the caps A to obtain filled capsule products C such as pharmaceutical capsules or capsule foods. In this instance, in the filling machine of the present embodiment, the contents substance filling unit 31 including the force feeding screws 33 disposed in the chamber 32 is used to compulsorily force feed contents substance m supplied into the chamber 32 to the bodies B by the force feeding screws 33.

Accordingly, with the capsule filling machine of the present embodiment, even if the contents substance m to be filled into capsules is low in bulk density and inferior in formability and fluidity such as crushed substance of weeds, grass or tea leaves or powder of silicon dioxide, it can be compulsorily force fed and filled into the bodies B by the force feeding screws 33, and filled capsule products in which a predetermined amount of contents substance m is filled can be produced stably and with certainty.

It is to be noted that the capsule filling machine of the present invention is not limited to the embodiment described above, the constructions of the supplying section for supplying empty capsules while controlling the postures of them to an erected state, transport means for transporting the supplied empty capsules, separation means for separating the empty capsules during transportation into caps and bodies, coupling means for coupling the bodies, into which contents substance are filled, to the caps again, the means for discharging and recovering resulting filled capsule products, and so forth can be modified in various manners. For example, while, in the embodiment described above, when empty capsules are transferred from the supply drum 11 to the direction controlling drum 12, six after six empty capsules AB arranged in three rows by two columns are transferred after every other six empty capsules AB as shown in FIG. 3 such that the capsules are moved for the second rotation of the direction controlling drum 12, two after two empty capsules AB arranged in one row by two columns may alternatively be transferred after every other two empty capsules AB from the supply drum 11 to the direction controlling drum 12, and further, the empty capsules AB may be transferred to the direction controlling drum 12 during the first rotation of the supply drum 11.

Also the other constructions can be modified suitably without departing from the spirit of the present invention. Further, while the capsule filling machine of the present invention is suitably applied in order to fill contents substance which is low in bulk density and inferior in formability and fluidity such as crushed substance of weeds, grass or tea leaves or powder of silicon dioxide into capsules, the contents substance to be filled is not limited to such specific substances as mentioned above, but also ordinary contents substance having a good formability or fluidity can be filled well by the capsule filling machine of the present invention.

As described above, according to the present capsule filling machine, even if contents substance to be filled into capsules is low in bulk density and inferior in formability and fluidity such as crushed substance of weeds, grass or tea leaves or powder of silicon dioxide, the contents substance can be compulsorily force fed and filled into capsule bodies by the force feeding screws, and filled capsule products in which a predetermined mount of contents substance is filled can be produced stably and with certainty.

What is claimed is:

1. A capsule filling machine which includes a cap transport member having a cap pocket in the form of a through-hole for accommodating a cap of a capsule and a body transport member having a body pocket for accommodating a body of the capsule and wherein said cap transport member is placed on said body transport member such that said cap pocket and said body pocket are registered with each other and an empty capsule in a condition wherein the cap and the body are temporarily coupled to each other is accommodated into and transported in a capsule pocket formed from said cap pocket and said body pocket in an erected state wherein the cap is directed upwardly, and then, during transportation of the empty capsule, the cap and the body are separated from each other in said capsule pocket and said cap is held in said cap pocket while said body is held in said body pocket, whereafter said cap transport member and said body transport member are separated from each other once and contents substance is filled into the body accommodated in said body pocket of said body transport member, and then said cap transport member is placed onto said body transport member such that said cap pocket and said body pocket are registered with each other and the cap and the body are coupled to each other within said capsule pocket formed from said cap pocket and said body pocket to produce a filled capsule product, wherein the capsule filling machine comprises a contents substance filling member including a force feeding screw disposed in a chamber having a lower end opening disposed above said body transport member, and said cap transport member includes a plurality of segments, at least one of said segments including said cap pocket, said segments being individually vertically movable with respect to one another in a vertical direction away from said body transport member from a first position to a second position, wherein when said cap transport member and said body transport member are vertically separated from each other, contents substance is directly force fed and filled into the body accommodated in said body pocket of said body transport member by said force feeding screw of said contents substance filling member.

2. A capsule filling machine according to claim 1, wherein it comprises, as said body transport member, a body disk in the form of a disk or a ring plate having a plurality of body pockets formed in a line along a circumferential direction, and, as said cap transport member, a plurality of cap segments each having one or a plurality of cap pockets and disposed for upward and downward movement on said body disk in a condition wherein said cap pockets and said body pockets are registered with each other.

3. A capsule filling machine according to claim 1, wherein said cap pocket has an offset provided at a lower end portion thereof such that the body of the capsule can pass through said offset but the cap of the capsule cannot pass through said offset, and a plunger pin is disposed for upward and downward movement in said body pocket, and wherein an empty capsule accommodated in said capsule pocket formed from said cap pocket and said body pocket is sucked from said body pocket side to separate the empty capsule into the cap and the body and the cap is held in said cap pocket while the body is held in said body pocket, and then after contents substance is filled into the body, the body accommodated in said body pocket is pushed up by said plunger pin to couple the body to the cap accommodated in said cap pocket again.

4. A capsule filling machine comprising:

a body transport member including a disk rotatable about an axis, said disk having at least one body pocket for accommodating a body of a capsule;

a cap transport member including a ring overlying said disk, said ring being rotatable about said axis, said ring including a plurality of ring segments, at least one of said ring segments having at least one cap pocket for accommodating a cap of a capsule, said ring segments being individually vertically movable with respect to one another in a vertical direction away from said disk from a first position to a second position; and a contents substance filling member including a chamber having a lower end disposed above said disk and below said ring segments when said ring segments are located in said second position, said chamber including a feeding screw located therein for directly force feeding contents substance into a body of a capsule located in said body pocket of said disk.

5. The capsule filling machine according to claim 4, wherein said ring segments have a substantially sectoral shape.

6. The capsule filling machine according to claim 4, wherein said disk is substantially circular.

7. The capsule filling machine according to claim 4, wherein said ring is substantially circular.

8. The capsule filling machine according to claim 4, wherein said lower end of said chamber is located between said disk and said ring.

9. The capsule filling machine according to claim 4, wherein said disk, said ring and said lower end of said chamber are in alignment with one another.

10. The capsule filling machine according to claim 4, wherein said disk of said body transport member is a continuous unbroken circular member.

11. The capsule filling machine according to claim 4, wherein said axis is a vertical axis.

12. The capsule filling machine according to claim 11, wherein said feeding screw is inclined with respect to said vertical axis.

13. A capsule filling machine comprising:

a body transport member having at least one body pocket for accommodating a body of a capsule;

a cap transport member including a plurality of segments, at least one of said segments having at least one cap pocket for accommodating a cap of a capsule, said segments of said cap transport member being individually vertically movable with respect to one another in a vertical direction away from said body transport member from a first position to a second position; and a contents substance filling member including a chamber having a lower end disposed above said body transport member and below said cap transport member when said cap transport member is located in said second position, said chamber including a feeding screw located therein for directly force feeding contents substance into a body of a capsule located in said body pocket of said body transport member.

14. The capsule filling machine according to claim 13, wherein said segments together form a substantially circular ring rotatable about an axis.

15. The capsule filling machine according to claim 13, wherein said feeding screw is inclined with respect to a vertical axis.

16. The capsule filling machine according to claim 13, wherein said lower end of said chamber is located between said body transport member and said cap transport member.

17. The capsule filling machine according to claim 13, wherein said body transport member, said cap transport member and said lower end of said chamber are in alignment with one another.

18. The capsule filling machine according to claim 13, wherein said body transport member is a continuous unbroken circular disk.

19. The capsule filling machine according to claim 13, wherein said body transport member includes a disk rotatable about an axis.

20. The capsule filling machine according to claim 19, wherein said disk is substantially circular.

21. The capsule filling machine according to claim 19, wherein said axis is a vertical axis.

22. The capsule filling machine according to claim 13, wherein said cap transport member includes a ring rotatable about an axis.

23. The capsule filling machine according to claim 22, wherein said ring is substantially circular.

24. The capsule filling machine according to claim 22, wherein said axis is a vertical axis.

* * * * *